US008948641B2

(12) United States Patent
Fujimoto et al.

(10) Patent No.: US 8,948,641 B2
(45) Date of Patent: Feb. 3, 2015

(54) FIXING DEVICE AND CONTROL METHOD USED THEREIN

(71) Applicants: Ippei Fujimoto, Kanagawa (JP); Hiroshi Seo, Kanagawa (JP); Ryota Yamashina, Kanagawa (JP); Takumi Waida, Tokyo (JP)

(72) Inventors: Ippei Fujimoto, Kanagawa (JP); Hiroshi Seo, Kanagawa (JP); Ryota Yamashina, Kanagawa (JP); Takumi Waida, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 37 days.

(21) Appl. No.: 13/759,349

(22) Filed: Feb. 5, 2013

(65) Prior Publication Data

US 2013/0209127 A1 Aug. 15, 2013

(30) Foreign Application Priority Data

Feb. 9, 2012 (JP) ..... 2012-026073

(51) Int. Cl.
*G03G 15/20* (2006.01)
*G03G 13/20* (2006.01)

(52) U.S. Cl.
CPC ..... *G03G 15/205* (2013.01); *G03G 13/20* (2013.01); *G03G 15/2046* (2013.01); *G03G 2215/2035* (2013.01)
USPC ..... 399/69; 399/67; 399/328; 399/329

(58) Field of Classification Search
USPC ..... 399/67, 68, 69, 329, 320, 328, 337
See application file for complete search history.

(56) References Cited

U.S. PATENT DOCUMENTS

| | | | | |
|---|---|---|---|---|
| 6,791,671 | B1 * | 9/2004 | Hayashi et al. | 355/405 |
| 7,356,275 | B2 * | 4/2008 | Baruch et al. | 399/68 |
| 2004/0223777 | A1 * | 11/2004 | Cao et al. | 399/68 |
| 2005/0214014 | A1 * | 9/2005 | Baruch et al. | 399/69 |
| 2006/0165443 | A1 | 7/2006 | Yoshinaga et al. | |
| 2006/0177232 | A1 | 8/2006 | Ehara et al. | |
| 2007/0003334 | A1 | 1/2007 | Shinshi et al. | |
| 2007/0059003 | A1 | 3/2007 | Shinshi et al. | |
| 2007/0059011 | A1 | 3/2007 | Seo et al. | |
| 2007/0212089 | A1 | 9/2007 | Seo et al. | |
| 2007/0280754 | A1 | 12/2007 | Ogawa et al. | |
| 2007/0292175 | A1 | 12/2007 | Shinshi | |
| 2008/0031648 | A1 * | 2/2008 | Iwasaki et al. | 399/69 |

(Continued)

FOREIGN PATENT DOCUMENTS

| | | |
|---|---|---|
| JP | 8-278725 | 10/1996 |
| JP | 2006-133580 | 5/2006 |

(Continued)

*Primary Examiner* — Francis Gray
(74) *Attorney, Agent, or Firm* — Harness, Dickey & Pierce

(57) ABSTRACT

A fixing device includes a rotatable fuser member, a rotatable pressure member, a heater, a temperature detector, and a controller. The rotatable fuser member is subjected to heating. The rotatable pressure member is disposed opposite the fuser member. The pressure member presses against the fuser member to form a fixing nip therebetween. The heater is disposed adjacent to the fuser member to heat the fuser member. The temperature detector is directed to at least one of the fuser member, the pressure member, and the heater to detect an operational temperature of the fixing device. The controller is operatively connected to the temperature detector and the heater to control power supply to the heater according to readings of the temperature detector, so as to regulate the detected operational temperature at a setpoint temperature that is variable depending on a print page printed on the recording medium.

19 Claims, 10 Drawing Sheets

(56) References Cited

U.S. PATENT DOCUMENTS

| | | | | |
|---|---|---|---|---|
| 2008/0044196 | A1 | 2/2008 | Seo et al. | |
| 2008/0253789 | A1 | 10/2008 | Yoshinaga et al. | |
| 2009/0003867 | A1 | 1/2009 | Fujimoto | |
| 2009/0169232 | A1 | 7/2009 | Kunii et al. | |
| 2009/0252520 | A1* | 10/2009 | Segawa | 399/69 |
| 2009/0297199 | A1 | 12/2009 | Yamashina et al. | |
| 2010/0061754 | A1 | 3/2010 | Ishigaya et al. | |
| 2010/0092220 | A1 | 4/2010 | Hasegawa et al. | |
| 2010/0092221 | A1 | 4/2010 | Shinshi et al. | |
| 2010/0232822 | A1 | 9/2010 | Takenaka et al. | |
| 2010/0290822 | A1 | 11/2010 | Hasegawa et al. | |
| 2011/0026988 | A1 | 2/2011 | Yoshikawa et al. | |
| 2011/0044734 | A1 | 2/2011 | Shimokawa et al. | |
| 2011/0052224 | A1 | 3/2011 | Yamashina et al. | |
| 2011/0052237 | A1 | 3/2011 | Yoshikawa et al. | |
| 2011/0052245 | A1 | 3/2011 | Shinshi et al. | |
| 2011/0052277 | A1 | 3/2011 | Ueno et al. | |
| 2011/0052282 | A1 | 3/2011 | Shinshi et al. | |
| 2011/0058862 | A1 | 3/2011 | Yamaguchi et al. | |
| 2011/0058863 | A1 | 3/2011 | Shinshi et al. | |
| 2011/0058864 | A1 | 3/2011 | Fujimoto et al. | |
| 2011/0058865 | A1 | 3/2011 | Tokuda et al. | |
| 2011/0058866 | A1 | 3/2011 | Ishii et al. | |
| 2011/0064437 | A1 | 3/2011 | Yamashina et al. | |
| 2011/0064443 | A1 | 3/2011 | Iwaya et al. | |
| 2011/0064450 | A1 | 3/2011 | Ishii et al. | |
| 2011/0064490 | A1 | 3/2011 | Imada et al. | |
| 2011/0064502 | A1 | 3/2011 | Hase et al. | |
| 2011/0076071 | A1 | 3/2011 | Yamaguchi et al. | |
| 2011/0085832 | A1 | 4/2011 | Hasegawa et al. | |
| 2011/0091226 | A1 | 4/2011 | Ishigaya et al. | |
| 2011/0116848 | A1 | 5/2011 | Yamaguchi et al. | |
| 2011/0129268 | A1 | 6/2011 | Ishii et al. | |
| 2011/0182634 | A1 | 7/2011 | Ishigaya et al. | |
| 2011/0194870 | A1 | 8/2011 | Hase et al. | |
| 2011/0206402 | A1 | 8/2011 | Yamashina | |
| 2011/0206427 | A1 | 8/2011 | Iwaya et al. | |
| 2011/0217057 | A1 | 9/2011 | Yoshinaga et al. | |
| 2011/0222888 | A1 | 9/2011 | Ikebuchi et al. | |
| 2011/0222930 | A1 | 9/2011 | Fujimoto et al. | |
| 2011/0229181 | A1 | 9/2011 | Iwaya et al. | |
| 2011/0229200 | A1 | 9/2011 | Yamaguchi et al. | |
| 2011/0229225 | A1 | 9/2011 | Ishii et al. | |
| 2011/0229226 | A1 | 9/2011 | Tokuda et al. | |
| 2011/0229227 | A1 | 9/2011 | Yoshikawa et al. | |
| 2011/0274453 | A1 | 11/2011 | Shimokawa et al. | |
| 2011/0311284 | A1 | 12/2011 | Seo et al. | |
| 2012/0051774 | A1 | 3/2012 | Ikebuchi et al. | |
| 2012/0093532 | A1 | 4/2012 | Ishigaya et al. | |
| 2012/0093534 | A1 | 4/2012 | Waida et al. | |
| 2012/0114345 | A1 | 5/2012 | Fujimoto et al. | |
| 2012/0121303 | A1 | 5/2012 | Takagi et al. | |
| 2012/0121304 | A1 | 5/2012 | Tokuda et al. | |
| 2012/0121305 | A1 | 5/2012 | Yoshikawa et al. | |
| 2012/0148303 | A1 | 6/2012 | Yamaguchi et al. | |
| 2012/0155935 | A1 | 6/2012 | Yoshikawa et al. | |
| 2012/0155936 | A1 | 6/2012 | Yamaguchi et al. | |
| 2012/0177388 | A1 | 7/2012 | Imada et al. | |
| 2012/0177393 | A1 | 7/2012 | Ikebuchi et al. | |
| 2012/0177420 | A1 | 7/2012 | Shimokawa et al. | |
| 2012/0177423 | A1 | 7/2012 | Imada et al. | |
| 2012/0201547 | A1 | 8/2012 | Yamashina | |
| 2012/0219312 | A1 | 8/2012 | Yuasa et al. | |
| 2012/0224878 | A1 | 9/2012 | Ikebuchi et al. | |
| 2012/0237273 | A1 | 9/2012 | Yoshinaga et al. | |
| 2012/0243895 | A1 | 9/2012 | Samei et al. | |
| 2012/0301161 | A1 | 11/2012 | Fujimoto | |
| 2012/0328317 | A1* | 12/2012 | Matsuo et al. | 399/68 |

FOREIGN PATENT DOCUMENTS

| | | |
|---|---|---|
| JP | 2007-233011 | 9/2007 |
| JP | 2007-334205 | 12/2007 |
| JP | 2008-185638 | 8/2008 |
| JP | 2008-268784 | 11/2008 |
| JP | 2009-053421 | 3/2009 |
| JP | 2009-181065 | 8/2009 |
| JP | 2010-032625 | 2/2010 |
| JP | 2010-217257 | 9/2010 |

* cited by examiner

FIXING DEVICE AND CONTROL METHOD USED THEREIN

CROSS-REFERENCE TO RELATED APPLICATIONS

The present patent application claims priority pursuant to 35 U.S.C. §119 from Japanese Patent Application No. 2012-026073, filed on Feb. 9, 2012, which is hereby incorporated by reference herein in its entirety.

BACKGROUND OF THE INVENTION

1. Technical Field

The present invention relates to a fixing device and a control method used therein, and more particularly, to a fixing device for use in an image forming apparatus, such as a photocopier, facsimile machine, printer, plotter, or multifunctional machine incorporating several of these features, and a method for controlling temperature in the fixing device.

2. Background Art

In electrophotographic image forming apparatuses, such as photocopiers, facsimile machines, printers, plotters, or multifunctional machines incorporating several of these features, an image is formed by attracting developer or toner particles to a photoconductive surface for subsequent transfer to a recording medium such as a sheet of paper. After transfer, the imaging process is followed by a fixing process using a fixing device, which permanently fixes the toner image in place on the recording medium with heat and pressure.

In general, a fixing device employed in electrophotographic image formation includes a pair of generally cylindrical looped belts or rollers, one being heated for fusing toner ("fuser member") and the other being pressed against the heated one ("pressure member"), which together form a heated area of contact called a fixing nip. As a recording medium bearing a toner image thereupon enters the fixing nip, heat from the fuser member causes the toner particles to fuse and melt, while pressure between the fuser and pressure members causes the molten toner to set onto the recording medium.

To date, some fixing devices employ a fixing member consisting of a thin, flexible belt or film that exhibits an extremely low heat capacity. Using the low-heat capacity material substantially saves energy for heating the fixing member, and consequently allows for shortening a warm-up time required to heat the fixing member from a room temperature to an operational, reload temperature upon power-on, as well as a first-print time required to initiate and execute a user-submitted print request to perform printing on an initial print page, which is completed outputting the resulting print.

During sequential processing of multiple print pages, on which different types of images are printed, the temperature of the fixing member is controlled to a certain setpoint temperature. For example, the setpoint temperature may be fixed to a single value determined optimized for print properties of an initial print page. Processing all the multiple print pages with the single, fixed setpoint temperature is undesirable, however, because it would cause excessive or insufficient heating of the fixing member relative to specific properties of each print page, resulting in undue energy consumption and fixing failure. To prevent undue energy consumption and fixing failure, the fixing device may control temperature using a setpoint temperature that is variable depending on a print page printed on the recording medium.

The inventors have recognized that although effective for its intended purpose, the temperature control based on a variable setpoint temperature also has a drawback. As the setpoint temperature decreases during operation, the amount of heat applied to the fixing member also decreases, while the fixing member constantly loses a substantial amount of heat absorbed by the recording medium passing through the fixing nip, eventually causing the temperature of the fixing member to suddenly decline below the setpoint temperature. The problem is particularly pronounced where the fixing member is of a low-heat capacity material. An excessive reduction in the fixing temperature can cause a fixing failure, known in the art as "cold offset", in which the toner image partially comes off where the toner particles forming the image fail to fuse properly due to a lack of heat applied to the recording medium.

SUMMARY OF THE INVENTION

Exemplary aspects of the present invention are put forward in view of the above-described circumstances, and provide a novel fixing device.

In one exemplary embodiment, the fixing device includes a rotatable fuser member, a rotatable pressure member, a heater, a temperature detector, and a controller. The rotatable fuser member is subjected to heating. The rotatable pressure member is disposed opposite the fuser member. The pressure member presses against the fuser member to form a fixing nip therebetween, through which a recording medium is conveyed. The heater is disposed adjacent to the fuser member to heat the fuser member. The temperature detector is directed to at least one of the fuser member, the pressure member, and the heater to detect an operational temperature of the fixing device. The controller is operatively connected to the temperature detector and the heater to control power supply to the heater according to readings of the temperature detector, so as to regulate the detected operational temperature at a setpoint temperature that is variable depending on a print page printed on the recording medium. During sequential processing of multiple print pages, including a current print page and a previous print page immediately preceding the current print page, the controller adjusts the setpoint temperature for the current print page to a primary temperature calculated depending on properties of the current print page where the primary temperature is equal to or higher than the setpoint temperature used to print the previous print page, and to a secondary temperature higher than the primary temperature where the primary temperature is lower than the setpoint temperature used to print the previous print page.

Other exemplary aspects of the present invention are put forward in view of the above-described circumstances, and provide a novel control method.

In one exemplary embodiment, the control method is used to determine a setpoint temperature at which an operational temperature of a fixing device is regulated during sequential processing of multiple print pages, including a current print page and a previous print page immediately preceding the current page. The control method includes temperature setting and temperature change. The temperature setting step initially sets the setpoint temperature for the current print page to a provisional, primary temperature calculated depending on properties of the current print page. The temperature change step subsequently changes the setpoint temperature for the current print page to a secondary temperature higher than the primary temperature in a condition in which the primary temperature is lower than the setpoint temperature used to print the previous print page.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
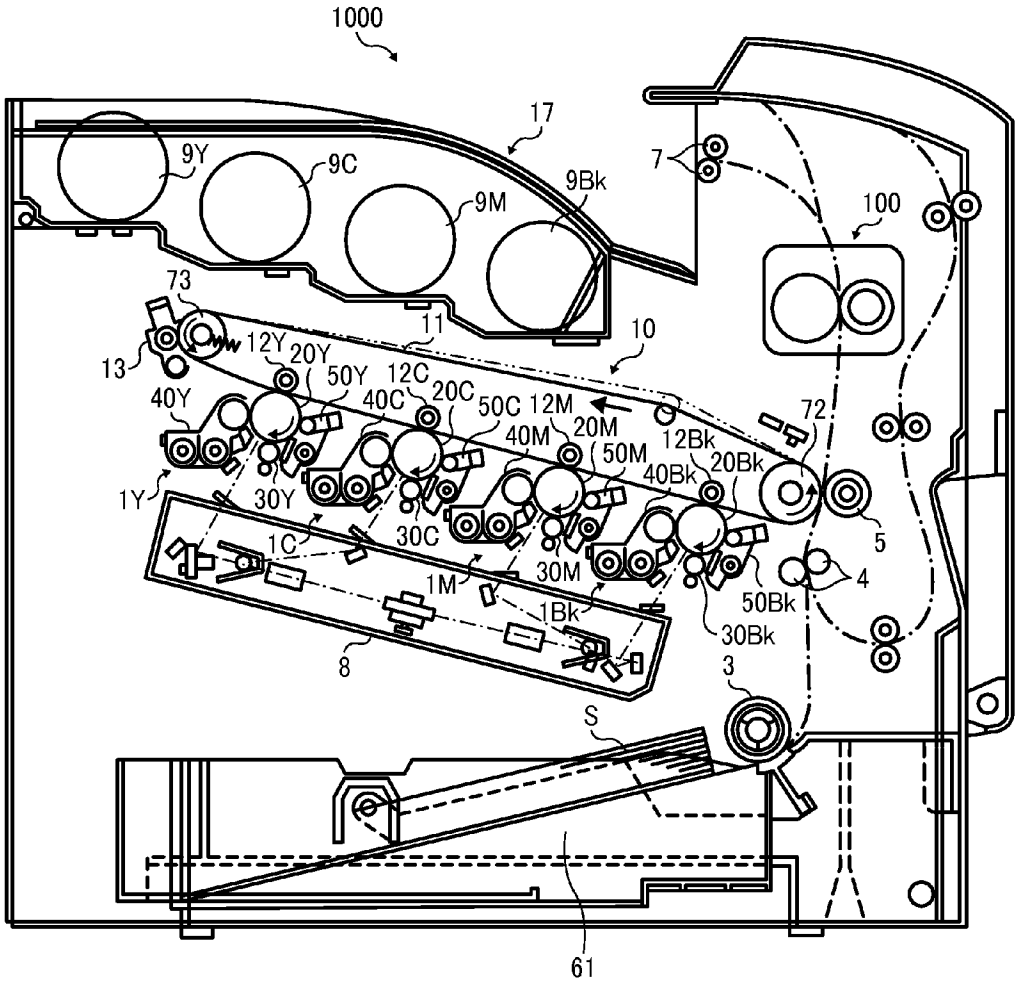
FIG. 1 schematically illustrates an image forming apparatus incorporating a fixing device according to one or more embodiments of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 1000 incorporating a fixing device 100 according to one or more embodiments of this patent specification.

As shown in FIG. 1, the image forming apparatus 1000 is configured as an electrophotographic color laser printer that forms a color image by combining images of yellow, magenta, and cyan (i.e., the complements of three subtractive primary colors) as well as black, including four electrophotographic imaging stations 1Y, 1C, 1M, and 1Bk arranged in series at the middle of the apparatus body, each having a substantially identical configuration, except for the color of toner accommodated therein, as designated by the suffixes "Y" for yellow, "C" for cyan, "M" for magenta, and "Bk" for black.

Each imaging station 1 includes a drum-shaped photoconductor 20 defining an outer, photoconductive surface on which a toner image is created, as well as various pieces of imaging equipment surrounding the photoconductor 20 to process the toner image in one rotation of the drum 20, including a charging roller 30 for uniformly charging the photoconductive surface, a development device 40 for applying toner to the photoconductive surface, and a cleaning device 50 for cleaning the photoconductive surface.

Below the imaging stations 1 is an exposure device 8 for exposing the photoconductive surface with light according to image data, consisting of a light source, such as a semiconductor laser, as well as various pieces of optical equipment, such as a coupling lens, an f–θ lens, a toroidal lens, a reflection mirror, and a deflector or rotatable polygon minor, which together direct laser or light beam modulated based on an image signal obtained by decomposing original image data.

Extending above the imaging stations 1 is an image transfer unit 10, including a looped, intermediate transfer belt 11, and four primary transfer rollers 12Y, 12C, 12M, and 12Bk disposed inside the loop of the belt 11, as well as a secondary transfer roller 5 and a belt cleaner 13 disposed outside the loop of the belt 11. The belt 11 is entrained around a transfer backup roller 72, a cleaning backup roller 73, and other belt support members. A rotary driver is provided to rotate the transfer backup roller 72, which serves as a driver roller to rotate the belt 11 counterclockwise in the drawing. An elastic biasing mechanism, such as a spring, is provided to the cleaning backup roller 73, which presses the roller 73 toward the belt cleaner 13 to maintain tension on the belt 11.

The four primary transfer rollers 12Y, 12C, 12M, and 12Bk each presses against an associated one of the photoconductors 20Y, 20C, 20M, and 20Bk via the belt 11 to form a primary transfer nip therebetween. An electrical bias applicator is connected to each primary transfer roller 12 to supply a primary electrical bias, such as a direct current (DC) voltage, an alternate current (AC) voltage, or a combination thereof, to the roller 12, such that the toner image is primarily transferred from the photoconductive surface to the intermediate transfer belt 11 through the primary transfer nip.

The secondary transfer roller 5 presses against the transfer backup roller 72 via the belt 11 to form a secondary transfer nip therebetween. An electrical bias applicator is connected to the secondary transfer roller 5 to supply a secondary electrical bias, such as a direct current (DC) voltage, an alternate current (AC) voltage, or a combination thereof, to the roller 5, such that the toner image is secondarily transferred from the intermediate transfer belt 11 to the recording sheet S through the secondary transfer nip.

The belt cleaner 13 includes a combination of a brush and a scraper blade disposed in contact with the intermediate transfer belt 11 downstream from the secondary transfer nip and upstream from the four primary transfer nips to remove toner and other residues from the belt surface after image transfer. The belt cleaner 13 has an outlet connected to a suitable toner conduit or hose, which transfers residual particles from the belt cleaner 13 for collection into a waste toner container.

At an upper portion of the apparatus body is a bottle rack accommodating four replaceable toner bottles 9Y, 9C, 9M, and 9Bk, containing toner for supply to the imaging units 1Y, 1C, 1M, and 1Bk, respectively. A toner supply path is provided between each tonner bottle 9 and its associated development device 40, through which fresh toner is supplied as needed by the development process.

At a lower portion of the apparatus body is a sheet cassette 61 accommodating a stack of recording media such as sheets of paper S. A feed roller 3 is disposed at one end of the sheet cassette 61 to contact the uppermost of the sheet stack for feeding the recording sheet S from the sheet cassette 61. A pair of registration rollers 4, a pair of output rollers 7, and other guide rollers or plates together form a sheet conveyance path, indicated by broken lines in the drawing, along which the recording sheet S is advanced from the input cassette 61, between the registration rollers 4, then through the secondary transfer nip, then through the fixing device 100, and then between the output rollers 7 to an output sheet tray 17 located atop the apparatus body. A sheet detector may be provided along the conveyance path to detect when the leading edge of the recording sheet S arrives between the registration rollers 4. A manual sheet supply tray may also be provided to allow manual supply of recording sheets S into the conveyance path.

During operation, each imaging station 1 rotates the photoconductor drum 20 clockwise in the drawing to forward its outer, photoconductive surface to a series of electrophotographic processes, including charging, exposure, development, transfer, and cleaning, in one rotation of the photoconductor drum 20.

First, the photoconductive surface is charged to a given uniform potential by the charging roller 30 and subsequently exposed to a laser beam emitted from the exposure device 8, which is modulated based on an image signal for a particular primary color obtained by decomposing the original image data into primary color components. The laser exposure selectively dissipates the charge on the photoconductive surface to form an electrostatic latent image thereon. Then, the latent image enters the development device 40, which renders the incoming image visible using toner. The toner image thus obtained is forwarded to the primary transfer nip between the primary transfer roller 12 and the photoconductor 20.

In the image transfer unit, the intermediate transfer belt 11 rotates counterclockwise in the drawing. At the primary transfer nip, the primary transfer roller 12 is electrified with a constant, current-controlled or voltage-controlled bias voltage of a potential opposite that of the toner being charged to form a primary transfer field between the photoconductor 20 and the primary transfer roller 12, under which the toner image is transferred from the photoconductor 20 to the intermediate transfer belt 11.

After primary image transfer, the photoconductor 20 enters the cleaning device 50, which removes untransferred, residual toner from the photoconductive surface, followed by a discharging device removing residual charge to establish an initial potential at the photoconductive surface.

As the multiple imaging stations 1 sequentially produce toner images of different colors at the four transfer nips along the belt travel path, the primary toner images are superimposed one atop another to form a single multicolor image on the moving surface of the intermediate transfer belt 11 for subsequent entry to the secondary transfer nip between the secondary transfer roller 5 and the transfer backup roller 72.

Meanwhile, at the bottom of the apparatus, the feed roller 3 introduces the recording sheet S from the sheet cassette 61 into the sheet conveyance path. Upon entering the sheet conveyance path, the recording sheet S reaches the pair of registration rollers 4 being rotated, which upon receiving the incoming sheet S, stops rotation to hold the sheet S therebetween, and then advances it in sync with the movement of the intermediate transfer belt 11 to the secondary transfer nip.

At the secondary transfer nip, the secondary transfer roller 5 is electrified with a bias voltage of a potential opposite that of the toner being charged to form a secondary transfer field between the transfer backup roller 72 and the secondary transfer roller 5, under which the multicolor toner image is transferred from the intermediate transfer belt 11 to the recording sheet S. The intermediate transfer belt 11 after exiting the secondary transfer nip reaches the belt cleaner 13, which cleans the belt surface of untransferred, residual toner, followed by the waste toner conduit transferring toner residues from the belt cleaner 13 to the waste toner container.

After secondary transfer, the recording sheet S is advanced to the fixing device 100 to fix the toner image in place under heat and pressure. Thereafter, the output roller pair 7 outputs the recording sheet S to the output tray 17 for stacking outside the apparatus body, which completes one operational cycle of the image forming apparatus 1000.

Although the embodiment above describes an operation in which the image forming apparatus 1000 reproduces a full-color image using all the four color imaging stations 1Y, 1C, 1M, and 1Bk, the image forming apparatus 1000 may operate in different modes of operation, such as a monochrome printing mode in which only a single imaging station is selectively activated to form a monochrome image, as well as a dual- or tri-color printing mode in which two or three imaging stations are selectively activated to form a multicolor image, depending on a specific print request submitted.

The fixing device 100 is applicable to various types of image forming apparatus, such as a photocopier, facsimile machine, printer, plotter, or multifunctional machine incorporating several of these features, which can reproduce a color image on a recording medium S according to image data. Various types of recording medium S may be used for electrophotographic image formation, including, but are not limited to, normal copy paper, cardboard, postcard, envelope, tissue paper, coated paper, enamel paper, art paper, tracing paper, and transparency for overhead projection (OHP).

Figure 2:
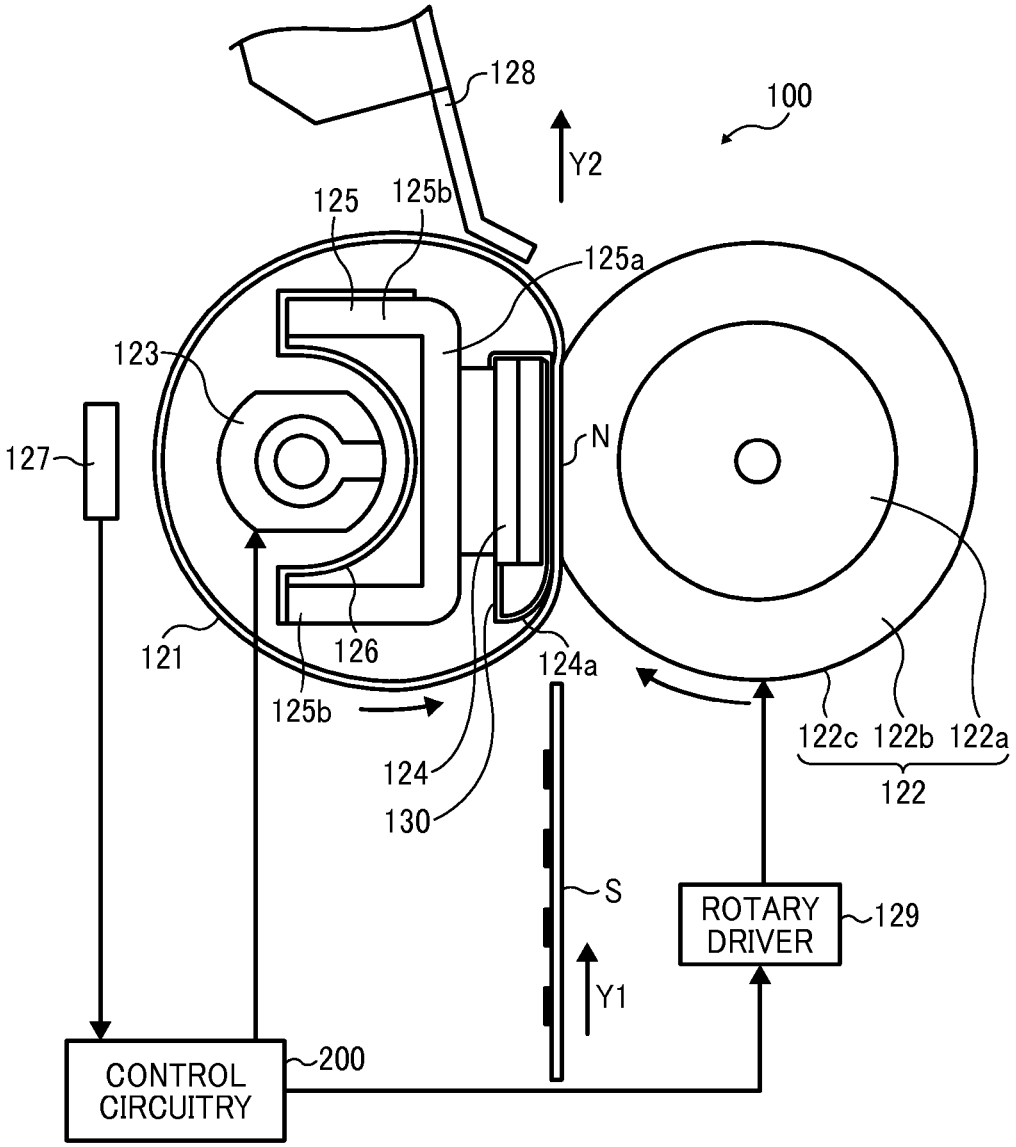
FIG. 2 is an end-on, axial view of the fixing device according to one embodiment of this patent specification.

FIG. 2 is an end-on, axial view of the fixing device 100 according to one embodiment of this patent specification.

As shown in FIG. 2, the fixing device 100 includes a looped, rotatable fuser belt 121 subjected to heating; a fuser pad 124 disposed inside the loop of the belt 121; and a rotatable pressure roller 122 disposed opposite the fuser belt 121. The pressure roller 122 presses against the fuser pad 124 via the fuser belt 121 to form a fixing nip N therebetween, through which a recording sheet S is conveyed in a sheet conveyance direction Y to fix a toner image in place with heat and pressure.

The fixing device 100 also includes a heater 123 disposed adjacent to the fuser belt 121 to heat the fuser belt 121; a temperature detector or thermometer 127 directed to the fuser belt 121 to detect a temperature of the fuser belt 121; and a rotary drive motor 129 connected to the pressure roller 122 via a gear train to impart torque to the pressure roller 122, which in turn rotates the belt 121 in frictional contact with the pressure roller 122.

Control circuitry 200 is operatively connected to the temperature sensor 127, the heater 123, and the rotary drive motor 129 to control rotation of the pressure roller 122 and power supply to the heater 123 according to readings of the temperature sensor 127, so as to regulate the temperature of the fuser belt 121 detected by the thermometer 129 at a desired setpoint temperature.

Also included in the fixing device 100 are a reinforcing stay 125 disposed in contact with the fuser pad 124 inside the loop of the belt 121 to reinforce the fuser pad 124 against pressure from the pressure roller 122; a reflector 126 interposed between the heater 123 and the stay 125 to reflect radiation from the heater 123; and a sheet separator 128 disposed downstream from the fixing nip N to separate the recoding sheet S from the fuser belt 121 at the exit from the fixing nip N.

Although not specifically depicted, a suitable biasing mechanism, such as a spring, may be provided to press the pressure roller 122 against the fuser pad 124 via the fuser belt 121. Elongated components, such as the heater 123 and the stay 125, may have their opposed longitudinal ends affixed to a pair of sidewalls 142 of the fixing device 100 (see FIGS. 3A and 3B, for example).

During operation, power supplies to the rotary driver and the heater 123 are both established as the image forming apparatus 1000 is powered on. Upon activation, the pressure roller 122 rotates in a given rotational direction (i.e., clockwise in the drawing) to transmit torque to the fuser belt 121 in frictional contact with the pressure roller 122, so that the belt 121 rotates in a rotational direction opposite that of the pressure roller 122 (i.e., counterclockwise in the drawing). The heater 123 radiates heat to the fuser belt 121 from inside the loop of the rotating belt 121.

Then, a recording sheet S bearing an unfixed, powder toner image enters the fixing device 100 while guided by a suitable guide member, such as a plate. As the rotary fixing members rotate together, the incoming sheet S passes through the fixing nip N in the sheet conveyance direction Y1 to fix the toner image in place, wherein heat from the fuser belt 121 causes toner particles to fuse and melt, while pressure between the fuser belt 121 and the pressure roller 122 causes the molten toner to settle onto the sheet surface.

After fixing, the recording sheet S advances in the sheet conveyance direction Y2 with its leading edge brought into contact with the sheet separator 128 to cause it separate from the fuser belt 121 downstream from the fixing nip N. The recording sheet S thus exiting the fixing nip N subsequently reaches the output roller pair 7, which, as described earlier, directs the sheet S into the output sheet tray 17 for stacking outside the apparatus body.

In the fixing device 100, the fuser belt 121 comprises a flexible, endless belt or film consisting of an inner, thermally conductive substrate defining an inner circumferential surface that faces the fuser pad 124 inside the loop of the belt 121, and an outer release layer defining an outer circumferential surface that faces the pressure roller 122 outside the loop of the belt 121 to allow for ready release of toner from the belt 121.

Optionally, an intermediate elastic layer may be provided between the substrate and the release layer of the belt 121. The intermediate elastic layer serves to accommodate minute variations in applied pressure to maintain smoothness of the belt surface at the fixing nip N, as the elastic layer itself deforms under nip pressure. Provision of the intermediate elastic layer thus ensures a resulting print exhibits a smooth, consistent appearance without image defects, such as an orange peel-like texture with non-uniform gloss across a solid image, which would occur where the fused toner material conforms to irregular shapes of the belt surface. For effective prevention against image defects, the intermediate elastic layer may have a thickness of approximately 100 micrometers (μm) or more.

The substrate of the belt 121 may be formed of thermally conductive material, including nickel, stainless, or any suitable metal, as well as synthetic resin such as polyimide (PI). The elastic layer of the belt 121 may be a deposit of rubber, such as solid or foamed silicone rubber, fluorine resin, or the like. The outer release layer may be a deposit of a release agent, such as tetra fluoro ethylene-perfluoro alkylvinyl ether copolymer or PFA, polytetrafluoroethylene (PTFE), polyimide (PI), or the like.

For energy-efficient, fast printing performance, the fuser belt 121 may be formed of a thin, small-diameter material that exhibits a low heat capacity. The thicknesses of the substrate, the elastic layer, and the release layer of the belt 121 are between approximately 20 μm and approximately 50 μm, between approximately 100 μm and approximately 300 μm, and between approximately 10 μm and approximately 50 μm, respectively, such that the entire thickness of the multilayered belt 121 falls to approximately 1 mm or less. For obtaining an extremely low heat capacity, the belt thickness may be regulated to 0.2 mm or less, and preferably, 0.16 mm or less. The belt 121 in its looped, generally cylindrical configuration has a diameter in a range of between approximately 20 mm and approximately 40 mm, and preferably, equal to or smaller than 30 mm.

The pressure roller 122 comprises a motor-driven, elastically biased cylindrical body formed of a cylindrical core 122*a* of metal, covered with an elastic layer 122*b* of rubber, such as sponged or solid silicone rubber, fluorine rubber, or the like. An additional, thin outer layer 122*c* of release agent, such as PFA, PTFE, or the like, may be deposited upon the elastic layer 122*b*.

The elastic layer 122*b* accommodates minute variations in applied pressure to maintain smoothness of the belt surface at the fixing nip N, as the elastic layer itself deforms under nip pressure, thereby preventing variations in gloss across a resulting image, which would occur where the fused toner material conforms to irregular shapes of the belt surface. For effective protection against image gloss variations, the elastic layer 122*b* may have a thickness of approximately 100 μm or more.

The elastic layer 122*b* may be formed of thermally insulative, sponged rubber, as opposed to solid rubber, particularly where the pressure roller 122 is not subjected to heating. The elastic layer 122*b* of sponged material effectively serves as an insulator that prevents heat conduction from the fuser belt 121 toward the pressure roller 122, leading to high thermal efficiency in heating the fuser belt 121 in the fixing device 100.

Although provision of the elastic layer 122*b* allows for reduced image gloss variations and other advantageous effects, forming the pressure roller 122 without the elastic layer 122*b* is also possible, which would allow for good fixing performance owing to a low heat capacity of the pressure roller 122.

The pressure roller 122 is connected to the rotary driver 129 via a transmission mechanism, such as a gear train, which imparts a rotational force or torque to rotate the cylindrical body. The pressure roller 122 is equipped with a biasing mechanism that elastically presses the cylindrical body against the fuser belt assembly, such that the elastic layer 122*b* deforms to establish the fixing nip N extending across a given length in the sheet conveyance direction where the pressure roller 122 presses against, or otherwise contacts, the fuser belt 121. Optionally, the pressure roller 122 may have a dedicated heater, such as a halogen heater, in which case the pressure roller 122 may be configured as a hollow cylinder, instead of a solid cylindrical body, to accommodate the heater therein.

The pressure roller 122 has a diameter similar to that of the fuser belt 121, such as in a range of between approximately 20 mm and approximately 40 mm. Instead, it is possible to provide the generally cylindrical fixing members 121 and 122 with different diameters. For example, it is possible to form the fuser belt 121 with a diameter smaller than that of the pressure roller 122, so that the fuser belt 121 exhibits a greater curvature than that of the pressure roller 122 at the fixing nip N, which effects good stripping of a recording sheet S from the fuser belt 121 upon exiting the fixing nip N.

The heater 123 may be any suitable electrical heat source. Examples include electrical resistance heater, such as a halogen lamp or a ceramic heater, as well as electromagnetic induction heater (IH). For example, in the present embodiment, the heater 123 is configured as a halogen heater disposed inside the loop of the belt 121 to radiate heat to the belt 121. Although a single heater is used in the present embodiment, the heater 123 may be configured otherwise than disclosed herein, and multiple heating elements may be disposed inside the loop of the belt 121.

During operation, the heater 123 radiates heat to the entire length of the belt 121 except at the fixing nip N, such that the belt 121 conducts heat to the toner image on the recording sheet S passing through the fixing nip N. Operation of the heater 123 is controlled so as to adjust an operational temperature of the fixing device, such as that measured at the fuser belt 121, to a desired fixing temperature, for example, through on-off control or other power supply control based on readings of the temperature sensor 127, such as a thermometer or thermistor, disposed facing an outer circumferential surface of the belt 121 to detect the belt temperature.

Direct heating the belt 121 from inside the belt loop allows for an energy-efficient, fast compact fixing process that can print with short warm-up time and first-print time without requiring a complicated or expensive heating assembly. That is, compared to radiation directed to a local, limited area of the belt, radiation from the heater 123 can simultaneously reach a relatively large area along the circumference of the belt 121, resulting in a sufficient amount of heat imparted to the belt 121 to prevent image defects even at high processing speeds.

The fuser pad 124 comprises an elongated piece of heat-resistant, sufficiently rigid material extending across the length of the fuser belt 121 or the pressure roller 122 in its axial, longitudinal direction to determine the size and strength of the fixing nip N as it receives pressure from the pressure roller 122.

The fuser pad 124 has a contact surface defined on its front side to face the pressure roller 122. In this embodiment, the contact surface of the fuser pad 124 is substantially flat. Alternatively, instead, the contact surface may have a slightly concave or other curved configuration. The concave configuration allows the contact surface to conform readily to the circumferential surface of the pressure roller 122, which prevents the recording sheet S from adhering to or winding around the fuser belt 121 upon exiting the fixing nip N, leading to reliable conveyance of the recording sheet S after fixing process.

The fuser pad 124 is formed of a heat-resistant material that exhibits heat resistance up to 200° C. or higher, as well as sufficient mechanical strength for withstanding nip pressure. High heat resistance and mechanical strength of the pad material ensures the fuser pad 124 does not bend or deform when subjected to pressure and heating at the operational, toner fusing temperature, which in turn stabilizes the size and strength of the fixing nip N for reliable imaging quality of the resulting image. Examples of suitable material for the fuser pad 124 include metal, ceramic, and heat-resistant resin, such as polyethersulfone (PES), polyphenylene sulfide (PPS), liquid crystal polymer (LCP), polyether nitrile (PEN), polyamide-imide (PAI), polyether ether ketone (PEEK), or the like.

The fuser pad 124, disposed inside the loop of the belt 121, may slide against the inner circumferential surface of the rotating belt 121 either directly or indirectly with a lubricant interposed between the pad and belt surfaces. In the present embodiment, for example, the fuser pad 124 is equipped with an optional, low-friction sheet 130 of lubricant-impregnated material disposed at least where the pad 124 contacts the fuser belt 121. Providing the low-friction sheet 130 between the adjoining surfaces of the fuser pad 124 and the fuser belt 121 prevents the fuser belt 121 from directly sliding against the fuser pad 124, which reduces torque required to drive the belt 121 during rotation while preventing damage to the belt 121 due to abrasive, frictional contact between the pad and belt surfaces.

The fuser pad 124 may have its upstream end extending beyond the fixing nip N to define a guide surface **124*a* along which the fuser belt 121 is guided upstream from the fixing nip N. The fuser belt 121, thus moving along the guide surface 124*a*** during rotation, can enter the fixing nip N safely and smoothly without substantial deflection or undesired radial movement upstream from the fixing nip N.

Provision of the guide surface **124*a* thus allows for safe, smooth rotation of the fuser belt 121 without involving a separate guide member (except for a pair of belt retainers 140 at the opposed longitudinal ends of the fuser belt 121, which will be described later in more detail). Smooth rotation of the fuser belt 121 in turn reduces load and abrasion on the fuser belt 121 and the fuser pad 124, thereby providing the reliable fixing process with high immunity against breakage or rupture of the fuser belt assembly. This arrangement is particularly effective in an energy-efficient, fast fixing process where the fuser belt 121 is formed of an extremely thin, low-heat capacity material. Moreover, eliminating the need for a separate guide member for the fuser belt 121** results in a compact, uncomplicated, and inexpensive fuser assembly, which also allows for a reduced heat-capacity, leading to a more energy-efficient fixing process with a reduced warm-up time and first-print time.

Also, absence of a separate guide member for the fuser belt 121 translates into absence of an intervening structure between the fuser belt 121 and the stay 125 (that is, the belt 121 directly faces the stay 125) upstream from and downstream from the fixing nip N, allowing for positioning the stay 125 extremely close to the inner circumferential surface of the belt 121. This arrangement allows for a larger configuration of the stay 125 within the limited space inside the loop of the fuser belt 121, leading to a greater mechanical strength of the reinforcement for the fuser pad 124, which effectively protects the fuser pad 124 from bending and deformation, thereby allowing reliable imaging performance of the fixing device 100 using the compact fuser assembly.

Further, in the present embodiment, the fuser pad 124 remains away from the fuser belt 121 where the pressure roller 122 is in its non-operational position away from the fuser belt 121. Such positioning of the fuser pad 124 prevents the fuser belt 121 from being excessively forced against the fuser pad 124 upstream and downstream from the fixing nip N, which would otherwise result in increased load and abrasion on the fuser belt 121 due to sliding contact with the fuser pad 124 during operation. Moreover, moderate contact pressure between the fuser belt 121 and the fuser pad 124 allows for optimized movement of the fuser belt 121 upon entry into the fixing nip N.

The reinforcing stay 125 comprises an elongated piece of rigid material having a length substantially identical to that of the fuser pad 124. The stay 125 supports the fuser pad 124 against pressure from the pressure roller 122 transmitted via the fuser belt 121, thereby protecting the fuser pad 124 from substantial bowing or deformation, which would otherwise cause variations in the size and strength of the fixing nip N. For providing sufficient reinforcement, the stay 125 may be formed of mechanically strong metal, such as stainless steel, iron, or the like.

In the present embodiment, the stay 125 is configured as a bent piece of material having a rectangular U-shaped axial cross-section, consisting of a center wall 125*a* defining a flat bearing surface to contact the fuser pad 124, and a pair of parallel upstanding walls 125*b*, each extending perpendicular from the center wall 125*a* and having a free, distal edge thereof pointing away from the center wall 125*a*. The stay 125, thus having a certain length in a direction of pressure from the pressure roller 122 owing to the provision of the upstanding walls 125*b*, exhibits a relatively high section modulus and high mechanical strength.

The heater 123 may be accommodated between the upstanding walls 125*b* of the stay 125, which allows for efficient deployment of the stay 125 and the heater 123 within the limited space inside the loop of the small-diameter fuser belt 121, leading to a compact, energy-efficient fixing process.

Figure 3A:
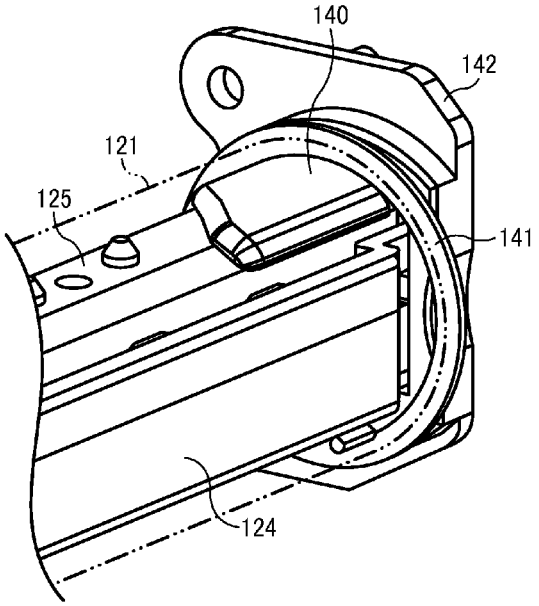
FIGS. 3A, 3B, and 3C are perspective, elevational, and end-on views, respectively, of the structure inside the loop of a fuser belt, shown in phantom lines, at one longitudinal end of the fuser assembly of FIG. 2.
Figure 3B:
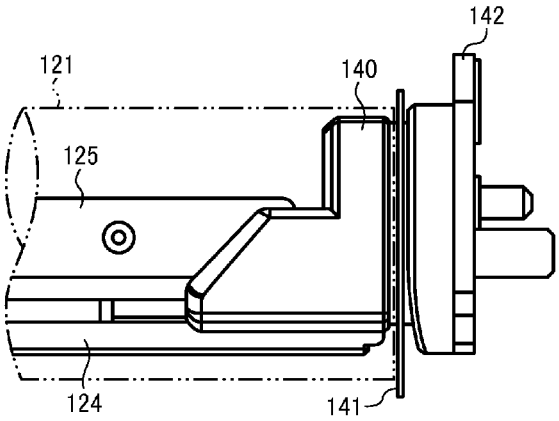
Figure 3C:
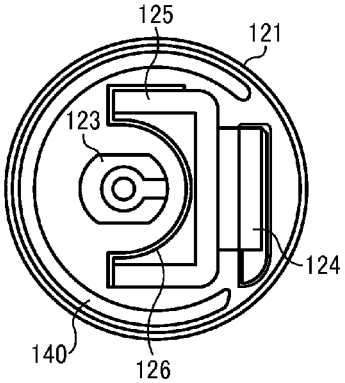

FIGS. 3A, 3B, and 3C are perspective, elevational, and end-on views, respectively, of the structure inside the loop of the fuser belt 121, shown in phantom lines, at one longitudinal end of the fuser assembly of FIG. 2. Specific views of the other longitudinal end, which are generally similar in configuration to those depicted in FIGS. 3A through 3C, are omitted for brevity.

As shown in FIGS. 3A through 3C, a pair of belt retainers 140, of which only one is visible in the drawings, are provided, one at each axial longitudinal end of the fuser belt 121 to retain the belt 121 in shape and position during rotation. The belt retainer 140 comprises a flange having a C-shaped cross-section, which is inserted into the loop of the fuser belt 121, with the open side of the C-shape aligned with the fuser pad 124. The belt retainer 140 is mounted to the sidewall 142 of the fixing device 100.

As mentioned earlier, the stay 125 may have its longitudinal end affixed in position to the sidewall 142. In such cases, the sidewall 142 may be formed of a material similar to that of which the stay 125 is formed, such as stainless steel, iron, or other types of metal. Forming the sidewall 142 and the stay 125 of the same material facilitates precise assembly of the fixing device 100.

Optionally, to protect the longitudinal end of the fuser belt 121 from abrasion and damage, an annular slip ring 141 may be provided where the edge of the belt 121 faces the belt retainer 140. Where the belt 121 walks or undergoes lateral displacement during rotation, the slip ring 141 prevents the belt edge from directly contacting the belt retainer 140, which would otherwise abrade or damage the belt edge.

The slip ring 141 may be loosely fitted around the belt retainer 140. Providing a small gap or clearance between the slip ring 141 and the belt retainer 140 allows the ring 141 to move or rotate when brought into contact with the edge of the rotating belt 121. The clearance between the ring 141 and the retainer 140 may be adjusted to keep the ring 141 stationary in position around the retainer 140. The slip ring 141 may be formed of a suitable low-friction, heat resistant material, in particular, super engineering plastics that exhibit superior heat resistance, such as PEEK, PPS, PAI, PTFE, or the like.

Additionally, although not specifically depicted, a heat shield may be provided at each longitudinal end of the fuser belt 121, which shields the belt ends against heat radiation from the heater 123. Provision of such shielding prevents excessive heating at those portions of the belt 121 that do not contact the recording sheet S conveyed through the fixing nip N, which would otherwise lead to thermal damage and degradation of the belt particularly where a large number of recording sheets are processed sequentially and continuously.

Figure 4:
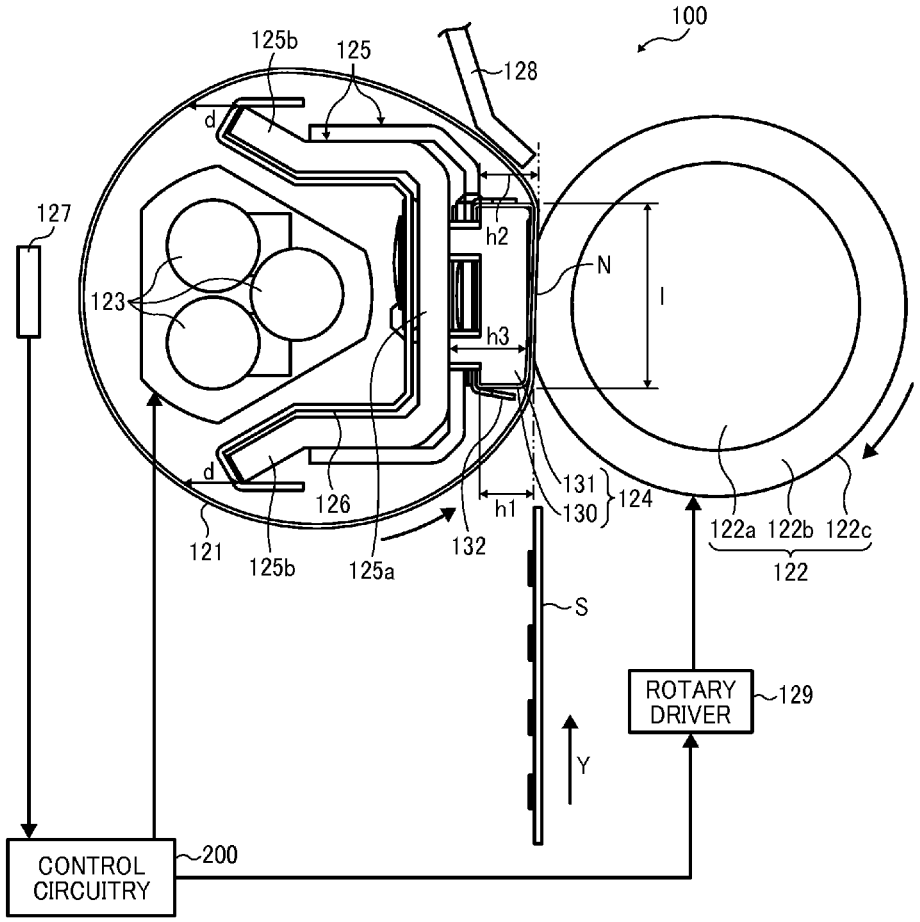
FIG. 4 is an end-on, axial view of the fixing device according to another embodiment of this patent specification.

FIG. 4 is an end-on, axial view of the fixing device 100 according to another embodiment of this patent specification.

As shown in FIG. 4, the overall configuration of the present embodiment is similar to that depicted primarily with reference to FIG. 2, including a looped, rotatable fuser belt 121 subjected to heating; a fuser pad 124 disposed inside the loop of the belt 121; and a rotatable pressure roller 122 disposed opposite the fuser belt 121.

Unlike the foregoing embodiment, the fixing device 100 includes a plurality of (e.g., three, in this case) independent heating elements or halogen heaters 123, instead of a single heater, and the fuser pad 124 is equipped with a formed sheet of metal 132 that surrounds the fuser pad 124 to stabilize position of the pad 124 with respect to the stay 125. Each of the heaters 123 is directed to a particular portion along the length of the fuser belt 121. Different portions of the fuser belt 121 may be heated using different heaters 123 or combination of heaters 123, which allows for efficient heating where different sizes of the recording medium S are accommodated in the fixing device 100.

The reinforcing stay 125 is configured as a bent piece of material having a rectangular U-shaped axial cross-section, consisting of a center wall 125*a* defining a flat bearing surface to contact the fuser pad 124, and a pair of upstanding walls 125*b*, each extending perpendicular from the center wall 125*a* and having a free, distal edge thereof pointing away from the center wall 125*a* and slightly angled away from each other. The stay 125, thus having a certain length in a direction of pressure from the pressure roller 122 owing to the provision of the upstanding walls 125*b*, exhibits a relatively high section modulus and high mechanical strength.

For efficient deployment of the fuser pad 124 and the stay 125 within the limited space inside the loop of the fuser belt 121, which can be further limited by the presence of multiple heaters 123, the fuser pad 124 and the stay 125 may be shaped and dimensioned relative to the adjacent structure of the fuser assembly.

Specifically, the fuser pad 124 may have a length 1 in the sheet conveyance direction (i.e., the direction in which the recording sheet S is conveyed through the fixing nip N) shorter than that of the stay 125. Also, the fuser pad 124, or more precisely the combined structure of the pad 124 and the low-friction sheet 130, may have heights h1 and h2 in the pressure direction (i.e., the direction in which the pressure roller 122 exerts pressure at the fixing nip N) measured at upstream and downstream edges thereof, respectively, both being equal to or shorter than a maximum height h3 measured at a position different from the upstream and downstream edges thereof.

In such a configuration, since each of the upstream and downstream edges of the fuser pad 124 does not intervene between the upstanding wall 125*b* of the stay 125 and the fuser belt 121, the stay 125 may be positioned extremely close to the inner circumferential surface of the fuser belt 121, which allows for a larger configuration of the stay 125 than is otherwise possible. Enlarging the stay 125 translates into a greater mechanical strength of the reinforcement for the fuser pad 124, which effectively protects the fuser pad 124 from bending and deformation, thereby allowing reliable imaging performance of the fixing device 100 using the compact fuser assembly.

Further, the stay 125 is positioned relative to the fuser belt 121 such that a distance d between a distal end of the upstanding wall 125*b* and the inner circumferential surface of the fuser belt 121 falls within an appropriate range.

Reducing the distance d allows for increasing the length and strength of the stay 125 in the pressure direction, while too small a distance d would cause the fuser belt 121 during rotation to interfere with the upstanding wall 125*b* of the stay 125. In particular, forming the belt 121 of an extremely thin flexible material, as is the case with the present embodiment, can increase the risk of interference between the belt 121 and the stay 125 as the thin flexible belt material is susceptible to a relatively large deflection or undesired radial movement during rotation.

Thus, a lower limit for the distance d may be specified depending on the specific configuration of the fuser belt assembly. For example, in the present embodiment, the distance d is set to a range that does not fall below a lower limit of approximately 2.0 mm, and preferably, approximately 3.0 mm. In a configuration in which the fuser belt 121 is sufficiently thick and is therefore exempt from substantial deflection or undesired radial movement, the distance d may be set to approximately 0.02 mm or larger. Where the stay 125 has the reflector 126 covering the distal end of the upstanding wall 125*b*, adjustment to the distance d is required so that the reflector 126 does not contact the fuser belt 121.

In such a configuration, the distal end of the stay 125 may be positioned extremely close to the inner circumferential surface of the fuser belt 121, which allows for a larger configuration of the stay 125, particularly in the pressure direction, than is otherwise possible. Enlarging the stay 125 translates into a greater mechanical strength of the reinforcement for the fuser pad 124, which effectively protects the fuser pad 124 from bending and deformation, thereby allowing reliable imaging performance of the fixing device 100 using the compact fuser assembly.

Figure 5:
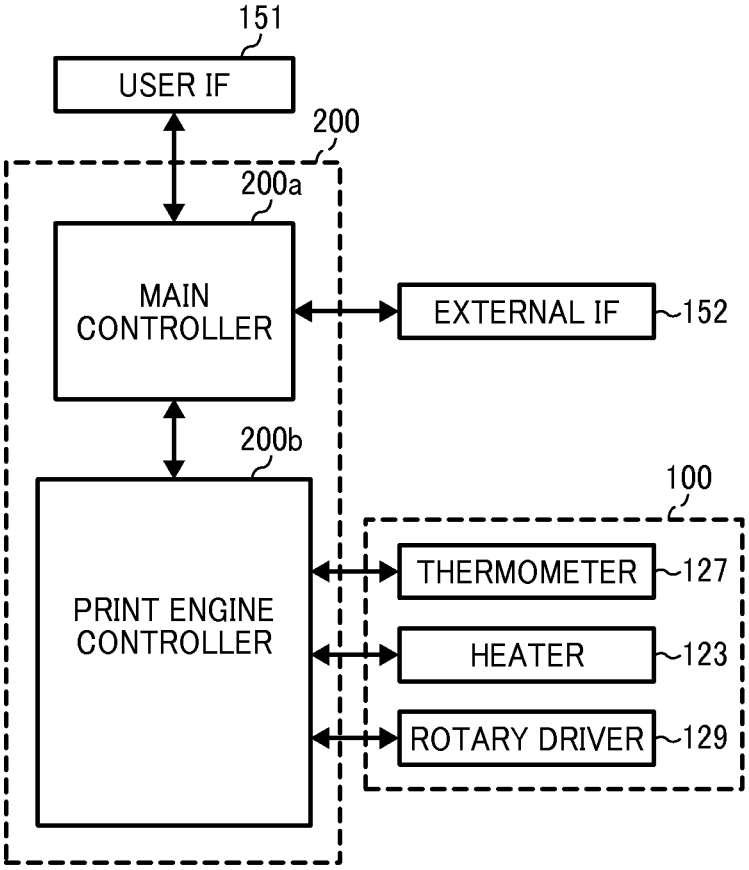
FIG. 5 is a block diagram of control circuitry for the fixing device included in the image forming apparatus of FIG. 1.

FIG. 5 is a block diagram of the control circuitry 200 for the fixing device 100 included in the image forming apparatus 1000.

As shown in FIG. 5, the control circuitry 200 includes a main controller 200*a* connected to a user interface 151 and an external interface 152, and a print engine controller 200*b* connected to the temperature detector or thermometer 127, the heater 123, and the rotary driver 129 of the pressure roller 122. The main controller 200*a* and the print engine controller 200*b* each comprises a central processing unit (CPU), and its associated memory devices, such as a read-only memory (ROM) storing program codes for execution by the CPU and other types of fixed data, and a random-access memory (RAM) for temporarily storing data.

In the control circuitry 200, the main controller 200*a* controls overall operation of the image forming apparatus 1000, and deals with information input and output through the user interface 151 and the external interface 152 through execution of computer programs installed therein. For example, the controller 200*a* may receive a request from a user through the user interface 151 to perform various types of processing according to the user-submitted request. Also, the controller 200*a* may receive a print job as well as image data from an external data source, such as a host computer, to direct the print engine controller 200*b* to perform image formation, either in color or in monochrome, as specified by the print request.

The print engine controller 200*b* controls operation of the print engine, such as, for example, the imaging stations 1, the exposure device 8, and the fixing device 100 through execution of computer programs installed therein under control of the main controller 200*a*. For example, during printing, the controller 200*b* directs the rotary driver 129 to rotate the pressure roller 122, while adjusting power supply to the heater 123 heating the fuser belt 121, so as to regulate the belt temperature detected by the thermometer 127 to a desired setpoint temperature that is variable depending on a print page printed on the recording medium.

The image forming apparatus 1000 is operable in different modes of operation, including, for example, a print mode in which the apparatus 1000 executes printing, with the monochrome printing mode and the color printing mode each being a sub-category of the print mode; a standby mode in which the apparatus 1000 waits for submission of a print request; and a sleep mode in which the apparatus 1000 stops unnecessary power supply to its subsystems, such as the print engine controller 200*b* and the print engine, so as to reduce power consumption to a level lower than that required in the standby mode.

The temperature of the fuser belt 121 may be controlled depending on the operational mode of the apparatus 1000. For example, in the print mode, the control circuitry 200 activates the fixing device 100 to initially heat the fuser belt 121 to a setpoint temperature of, for example, from 158° C. to 170° C., followed by entry of the recording sheet S into the fixing nip N to fix the toner image with heat and pressure. In the standby mode, the control circuitry 200 activates the fixing device 100 to keep the fuser belt 121 at a relatively low temperature of, for example, 90° C., which is lower than the setpoint temperature. In the sleep mode, the control circuitry 200 deactivates the fixing device 100, with the heater 123 powered off and the rotary driver 122 inactive.

As mentioned earlier, in the fixing device 100, the controller 200*b* is operatively connected to the temperature detector 127 and the heater 123 to control power supply to the heater 123 according to readings of the temperature detector 127, so as to regulate the detected operational temperature at a setpoint temperature that is variable depending on a print page printed on the recording sheet S.

According to this patent specification, during sequential processing of multiple print pages, including a current print page and a previous print page immediately preceding the current print page, the controller 200*b* adjusts the setpoint temperature for printing the current print page to a provisional, primary temperature calculated depending on properties of the current print page where the primary temperature is equal to or higher than the setpoint temperature used to print the previous print page, and to a secondary temperature higher than the primary temperature where the primary temperature is lower than the setpoint temperature used to print the previous print page.

In the following description, the setpoint temperature, which is adjustable for each of the multiple print pages, is designated by the capital letter "T", which may be followed by a subscript indicating the order of a particular print page in the print job. For example, the setpoint temperature T for a current, n-th print page is designated by "$T_n$", and that for a previous, (n−1)th print page is designated by "$T_{n-1}$". A default setpoint temperature $T_0$ may be set to 0° C.

Specifically, upon receiving a print request, the main controller 200*a* directs the print engine controller 200*b* to sequentially process multiple print pages included in a print job. The controller 200*b* determines a variable setpoint temperature T at which the operational temperature of the fixing device 100 is regulated during sequential processing of multiple print pages, including a current, n-th print page and a previous, (n−1)th print page immediately preceding the current print page.

To determine the setpoint temperature T, the controller 200*b* initially sets the setpoint temperature $T_n$ to a provisional, primary temperature TA calculated depending on properties of the current print page. The controller 200*b* may subsequently change the setpoint temperature $T_n$ to a secondary temperature TB higher than the primary temperature TA in a condition in which the primary temperature TA is lower than the setpoint temperature $T_{n-1}$ used to print the previous print page.

With the setpoint temperature $T_n$ thus determined, the controller 200*b* controls heater power supply to heat the fuser belt 121 to the setpoint temperature $T_n$ as the recording sheet S, on which the current print page is formed, passes through the fixing nip N.

In the present embodiment, the print properties used to calculate the primary temperature TA includes coloration of the print page, presence or absence of a halftone in the print page, and type of halftoning technique used to create a halftone in the print page.

Specifically, the provisional, primary temperature TA is obtained by subtracting a correction value Δ from a base temperature selected for the current print page. The base temperature is determined depending on whether the current print page is color or monochrome. The correction value is determined depending on whether the current print page contains halftone and the type of halftoning technique used, that is, in the present case, whether the current print page is error-diffused or dithered. The secondary temperature TB may be equal to the base temperature for the current print page.

For example, the base temperature may be set to a relatively low temperature Tm where the print page is monochrome, and to a relatively high temperature Tc where the print page is color. The correction value Δ may be set to a first, relatively large correction value Δa where the print page is a solid monochrome image; to a second, relatively small correction value Δb where the print page is a dithered monochrome image; to a third, relatively large correction value Δc where the print page is a solid color image; and to a fourth, relatively small correction value Δd where the print page is a dithered color image. Where the print page is halftoned through error-diffusion, the correction value is set to zero, that is, no subtraction from the base temperature to obtain the primary temperature TA.

As used herein, the term "halftone" refers to a print or a part of a print that simulates continuous tone imagery using image dots or minimum constituent of a toner image, which can be individually controlled and colored, for example, either in pure black or in pure white without gradation to create a binary, monochrome print. Specific examples of halftoning techniques include, but are not limited to, dithering and error diffusion.

In dithering, a single pixel of the original image is represented by a single image dot. Either a black or white dot is generated for each original pixel in a regulated manner according to grayscale of the pixel to create a visual effect of halftone by varying frequencies with which white and black dots appear. In error diffusion, a single pixel of the original image is represented by a plurality of image dots. Black and white dots are generated for each original pixel in a regulated manner according to grayscale of the pixel to create a visual effect of halftone by varying a ratio between the black and white dot numbers, that is, between areas of white and black in each pixel.

These halftoning techniques may be applied not only in monochrome printing but also in color printing, in which case image dots are created for each of the multiple primary colors, including, for example, yellow, cyan, magenta, and black, of the original image. Although the specific types of halftoning are described in the present embodiment, any halftoning technique may be employed in addition to or instead of those based on dithering and error diffusion.

Given the other conditions held constant, image fixability or the readiness with which a toner image is fixed on a recording medium may depend on whether the image is solid or halftoned, and whether the image is dithered or error-diffused. In general, solid, non-halftone images are easier to fix than halftone images. Moreover, halftone images created through dithering, which represents gradation using continuous lines and curves, as opposed to isolated dots of toner, are easier to fix than those created through error diffusion. Error-diffused images, which tend to involve more isolated dots of toner than continuous lines and curves, are hardest to fix and therefore require a sufficiently high operational temperature.

Thus, in the present embodiment, the temperature control establishes a relatively low setpoint temperature for a solid print page by subtracting the relatively large correction value Δa (for monochrome printing) or Δc (for color printing) from the base temperature, and a relatively high setpoint temperature for a dithered, halftone print page by subtracting the relatively small correction value Δb (for monochrome printing) or Δd (for color printing) from the base temperature. Also, the temperature control employs the base temperature without correction through subtraction of a correction value for an error-diffused, halftone print page.

Subtracting the correction value Δ from the base temperature to obtain the primary temperature TA of the setpoint temperature T allows for saving energy required to heat the fuser belt 121. For a specific type of recording medium, the base temperature is selected depending on coloration of the print page such that printing is performed without fixing failure, such as cold offset, even under most difficult, error-prone operational conditions. Color printing requires a higher temperature than monochrome printing, as the former involves a greater amount of toner applied to the recording medium than the latter. Not surprisingly, under easier operational conditions, printing with a temperature slightly lower than the base temperature does not cause any substantial image defect.

The number and strength of the correction values Δ involved in the determination of the setpoint temperature T may vary depending on specific applications. For example, two types of correction values Δ may be assigned for each of the two base temperatures Tm and Tc, as is the case with the present embodiment.

Figure 6:
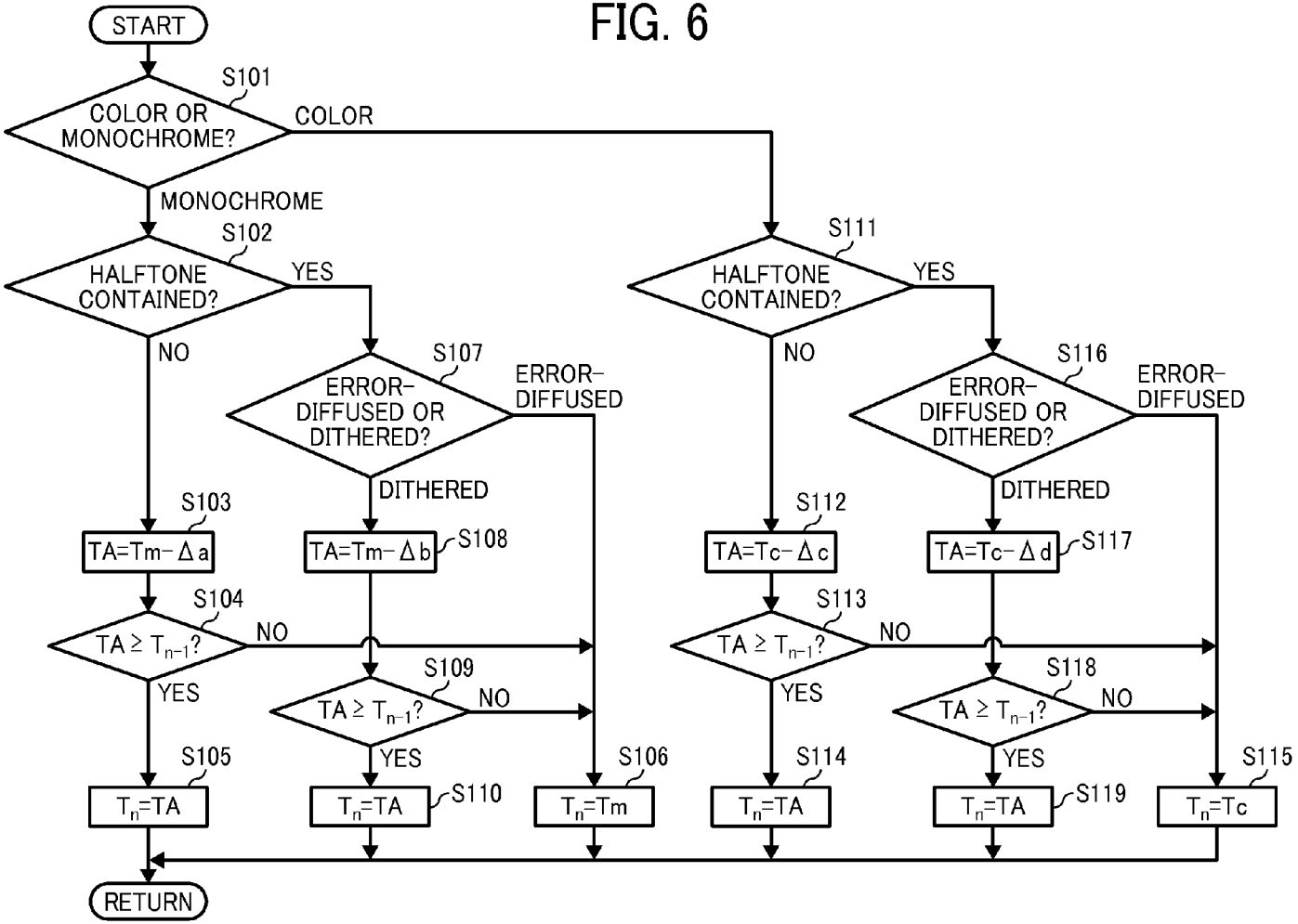
FIG. 6 is a flowchart illustrating temperature control according to one embodiment of this patent specification.

FIG. 6 is a flowchart illustrating temperature control determining the setpoint temperature $T_n$ for the current, n-th print page during sequential processing of multiple print pages according to one embodiment of this patent specification.

As shown in FIG. 6, the controller 200*b* initially determines whether the current, n-th print page is color or monochrome (step S101). For example, the coloration of the print page may be determined based on the type of printing mode, which may be specified either as a monochrome mode or as a color mode.

Where the current print page is monochrome ("MONOCHROME" in step S101), the controller 200*b* then determines whether the current print page contains a halftone or not (step S102). For example, the presence or absence of halftone in the print page may be determined based on CMYK color values of the pixels included in the original image data, each of which is specified in terms of percentage of cyan, magenta, yellow, and black components in the print, derived through conversion of an RGB color value, specified in terms of percentage of red, green, and blue components in the original image data as presented on a computer display during processing of a print request submitted from a host computer.

In such cases, a K value of 100% indicates the print page is a solid black image with no halftoning, which may be printed successfully even with a relatively low temperature. Contrarily, a K value in a range from zero to 99% indicates the print page is a halftone black image, which requires a relatively high temperature compared to that required for a solid image.

Where the current print page does not contain a halftone ("NO" in step S102), the controller 102*b* subtracts the relatively large correction value Δa from the base temperature Tm for monochrome printing to obtain the primary temperature TA (step S103). For example, the base temperature Tm may be determined according to image data specifying that the current print page is monochrome, and the correction value Δa may be determined according to image data specifying that the current print page is a solid monochrome image.

Then, the controller 200*b* compares the primary temperature TA against the setpoint temperature $T_{n-1}$ used to print the previous, (n−1)th print page to determine whether the primary temperature TA equals or exceeds the previous setpoint temperature $T_{n-1}$ (step S104).

Where the primary temperature TA equals or exceeds the previous setpoint temperature $T_{n-1}$ ("YES" in step S104), the setpoint temperature $T_n$ for the current print page is fixed to the primary temperature TA, that is, Tm−Δa (step S105), followed by heating the fuser belt 121 to the setpoint temperature $T_n$ thus determined.

Where the primary temperature TA is below the previous setpoint temperature $T_{n-1}$ ("NO" in step S104), the setpoint temperature $T_n$ for the current print page is fixed to the base temperature Tm for monochrome printing (step S106), followed by heating the fuser belt 121 to the setpoint temperature $T_n$ thus determined.

Where the current print page contains a halftone ("YES" in step S102), the controller 102*b* then determines whether the current print page is halftoned through dithering or through error diffusion (step S107).

Where the current print page is halftoned through dithering ("DITHERED" in step S107), the controller 102*b* subtracts the relatively small correction value Δb from the base temperature Tm for monochrome printing to obtain the primary temperature TA (step S108). For example, the base temperature Tm may be determined according to image data specifying that the current print page is monochrome, and the correction value Δb may be determined according to image data specifying that the current print page is a dithered monochrome image.

Then, the controller 200*b* compares the primary temperature TA against the setpoint temperature $T_{n-1}$ used to print the previous, (n−1)th print page to determine whether the primary temperature TA equals or exceeds the previous setpoint temperature $T_{n-1}$ (step S109).

Where the primary temperature TA equals or exceeds the previous setpoint temperature $T_{n-1}$ ("YES" in step S109), the setpoint temperature $T_n$ for the current print page is fixed to the primary temperature TA, that is, Tm−Δb (step S110), followed by heating the fuser belt 121 to the setpoint temperature $T_n$ thus determined.

Where the primary temperature TA is below the previous setpoint temperature $T_{n-1}$ ("NO" in step S109), the setpoint temperature $T_n$ for the current print page is fixed to the base temperature Tm for monochrome printing (step S106), followed by heating the fuser belt 121 to the setpoint temperature $T_n$ thus determined.

Where the current print page is halftoned through error diffusion ("ERROR-DIFFUSED" in step S107), the setpoint temperature $T_n$ for the current print page is fixed to the base temperature Tm for monochrome printing (step S106), followed by heating the fuser belt 121 to the setpoint temperature $T_n$ thus determined.

Where the current print page is color ("COLOR" in step S101), the controller 200*b* then determines whether the current print page contains a halftone or not (step S111).

Where the current print page does not contain a halftone ("NO" in step S111), the controller 102*b* subtracts the relatively large correction value Δc from the base temperature Tc for color printing to obtain the primary temperature TA (step S112).

Then, the controller 200*b* compares the primary temperature TA against the setpoint temperature $T_{n-1}$ used to print the previous, (n−1)th print page to determine whether the primary temperature TA equals or exceeds the previous setpoint temperature $T_{n-1}$ (step S113).

Where the primary temperature TA equals or exceeds the previous setpoint temperature $T_{n-1}$ ("YES" in step S113), the setpoint temperature $T_n$ for the current print page is fixed to the primary temperature TA, that is, Tc−Δc (step S114), followed by heating the fuser belt 121 to the setpoint temperature $T_n$ thus determined.

Where the primary temperature TA is below the previous setpoint temperature $T_{n-1}$ ("NO" in step S113), the setpoint temperature $T_n$ for the current print page is fixed to the base temperature Tc for color printing (step S115), followed by heating the fuser belt 121 to the setpoint temperature $T_n$ thus determined.

Where the current print page contains a halftone ("YES" in step S111), the controller 102*b* then determines whether the current print page is halftoned through dithering or through error diffusion (step S116).

Where the current print page is halftoned through dithering ("DITHERED" in step S116), the controller 102*b* subtracts the relatively small correction value Δd from the base temperature Tc for color printing to obtain the primary temperature TA (step S117).

Then, the controller 200*b* compares the primary temperature TA against the setpoint temperature $T_{n-1}$ used to print the previous, (n−1)th print page to determine whether the primary temperature TA equals or exceeds the previous setpoint temperature $T_{n-1}$ (step S118).

Where the primary temperature TA equals or exceeds the previous setpoint temperature $T_{n-1}$ ("YES" in step S118), the setpoint temperature $T_n$ for the current print page is fixed to the primary temperature TA, that is, Tc−Δd (step S119), followed by heating the fuser belt 121 to the setpoint temperature $T_n$ thus determined.

Where the primary temperature TA is below the previous setpoint temperature $T_{n-1}$ ("NO" in step S118), the setpoint temperature $T_n$ for the current print page is fixed to the base temperature Tc for color printing (step S115), followed by heating the fuser belt 121 to the setpoint temperature $T_n$ thus determined.

Where the current print page is halftoned through error diffusion ("ERROR-DIFFUSED" in step S116), the setpoint temperature $T_n$ for the current print page is fixed to the base temperature Tc for color printing (step S115), followed by heating the fuser belt 121 to the setpoint temperature $T_n$ thus determined.

Hence, during sequential processing of multiple print pages included in a print job, the control can optimize the setpoint temperature T of each print page through a simple, uncomplicated procedure based on image information specifying print properties, such as coloration, presence or absence of halftone, and type of halftoning technique of the current print page. Timely optimization of the setpoint temperature T effectively prevents a sudden, excessive reduction in temperature of the fuser belt of a low-heat capacity material, which would otherwise cause a concomitant image defect, such as cold offset, in the resulting print.

Figure 7:
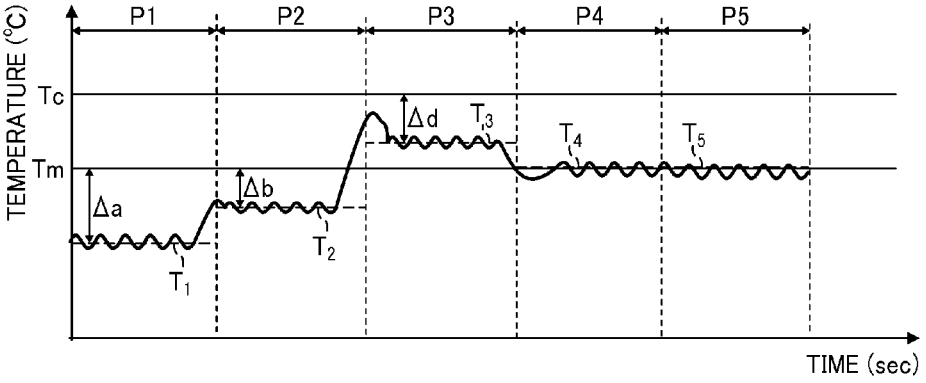
FIG. 7 is a graph plotting the temperature, in degrees Celsius (° C.), of the fuser belt against time, in seconds, during sequential processing of multiple print pages, obtained with variable setpoint temperatures determined through the temperature control of FIG. 6.

FIG. 7 is a graph plotting the temperature, in degrees Celsius (° C.), of the fuser belt 121 against time, in seconds, during sequential processing of multiple print pages, including a solid monochrome page P1, a dithered monochrome page P2, a dithered color page P3, a solid monochrome page P4, and a solid monochrome page P5, obtained with variable setpoint temperatures $T_1$ through $T_5$ determined through the temperature control of FIG. 6.

As shown in FIG. 7, the setpoint temperature $T_1$ for the first print page P1 is adjusted to the primary temperature Tm−Δa selected for the solid monochrome page, which is equal to or higher than the default setpoint temperature $T_0$ of, for example, 0° C.

The setpoint temperature $T_2$ for the second print page P2 is adjusted to the primary temperature Tm−Δb selected for the dithered monochrome page, which exceeds the setpoint temperature $T_1$ used to print the previous print page P1.

The setpoint temperature $T_3$ for the third print page P3 is adjusted to the primary temperature Tc−Δd selected for the dithered color page, which exceeds the setpoint temperature $T_2$ used to print the previous print page P2.

The setpoint temperature $T_4$ for the fourth print page P4 is adjusted to the secondary temperature Tm, higher than the primary temperature Tm−Δa selected for the solid monochrome page, as the primary temperature Tm−Δa is lower than the setpoint temperature $T_3$ used to print the previous print page P3.

The setpoint temperature $T_5$ for the fifth print page P5 is adjusted to the secondary temperature Tm, higher than the primary temperature Tm−Δa selected for the solid monochrome page, as the primary temperature Tm−Δa is lower than the setpoint temperature $T_4$ used to print the previous print page P4.

Thus, the first and second pages P1 and P2 are processed with the respective primary temperatures obtained by subtracting the correction values Δa and Δb, respectively, from the base temperature Tm for monochrome printing, and the third page P3 is processed with the primary temperature obtained by subtracting the correction value Δd from the base temperature Tc for color printing. On the other hand, the fourth and fifth pages P4 and P5 are processed with the secondary temperatures equal to the base temperature Tm for monochrome printing, which is higher than the corrected, primary temperature.

Hence, the temperature control according to this patent specification calculates the primary setpoint temperature for each print page by subtracting the correction value Δ from the base temperature selected to secure that printing is performed without fixing failure, such as cold offset, resulting in reduced energy consumption compared to that required where the base temperature is used without correction depending on properties of the print page.

Such temperature control allows for setting an appropriate setpoint temperature for each specific print page depending on print properties, including print coloration, presence or absence of halftone, and type of halftoning technique used, each of which can influence susceptibility to fixing failure due to insufficient or excessive heating of the fuser member. Further, calculation of the setpoint temperature is relatively uncomplicated, and therefore less susceptible to error, as it involves only those print properties readily obtainable from the image information.

Moreover, the temperature control can adjust the setpoint temperature to the secondary temperature equal to the base temperature for the current print page in a condition in which the primary temperature is lower than the setpoint temperature used to print the previous print page.

Such arrangement prevents an excessively large difference by which the setpoint temperature is reduced during sequential processing of two successive print pages, which would otherwise result in an elongated period of time during which the heater remains deactivated, leading to an undesired, sudden decline in the temperature of the low-heat capacity fuser member.

Figure 8:
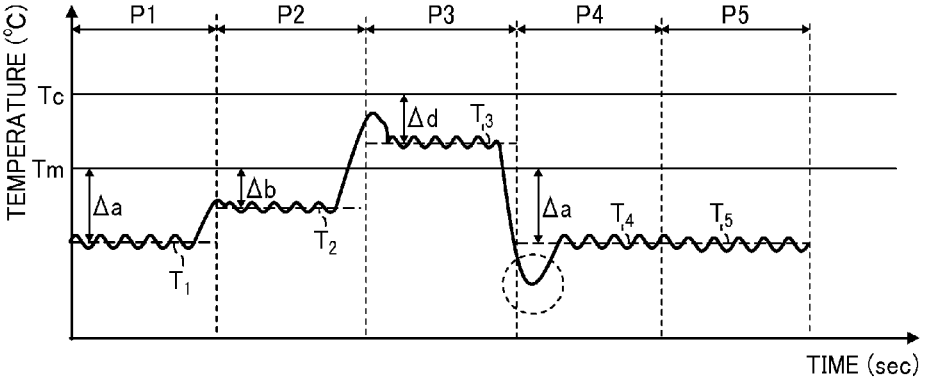
FIG. 8 is a graph plotting the temperature, in degrees Celsius (° C.), of the fuser belt against time, in seconds, during sequential processing of multiple print pages, obtained with variable setpoint temperatures determined through an exemplary temperature control.

For comparison purposes, consider a case in which multiple print pages P1 through P5 are processed without the temperature control based on the primary and secondary temperatures, with additional reference to FIG. 8.

As shown in FIG. 8, unlike the embodiment depicted in FIG. 7, in this case, the setpoint temperatures $T_4$ and $T_5$ for the fourth and fifth pages P4 and P5 are set to the corrected, primary temperature Tm−Δa selected for the solid monochrome page.

Note that during processing of the fourth page P4, the belt temperature suddenly falls below the designed setpoint temperature $T_4$, as indicated by a dashed circle in the graph. A large difference by which the setpoint temperature is reduced during sequential processing of two successive print pages P3 and P4 causes an elongated period of time during which the heater remains deactivated before processing the fourth page P4 while the recording sheet absorbs heat from the fuser belt, causing a sudden decline in the belt temperature.

In further embodiment, a difference between the setpoint temperature $T_n$ adjusted for the current print page and the setpoint temperature $T_{n-1}$ used to print the previous print page does not exceed a given threshold temperature difference ΔT.

Specifically, the controller 200*b* adjusts the setpoint temperature $T_n$ for the current print page to a temperature $T_{n-1}-\Delta T$ obtained by subtracting the threshold temperature difference ΔT from the setpoint temperature $T_{n-1}$ used to print the previous print page in a condition in which a difference between the primary temperature calculated depending on properties of the current print page and the setpoint temperature $T_{n-1}$ used to print the previous print page exceeds the threshold temperature difference.

The threshold temperature difference ΔT is defined as a maximum allowable difference between the setpoint temperatures with which two successive print pages are processed, and can be set to any suitable value depending on the heat capacity of the fuser member and the rating of the heater used in the fixing device. For example, in the present embodiment, the threshold temperature difference ΔT is set to 5° C.

Figure 9A:
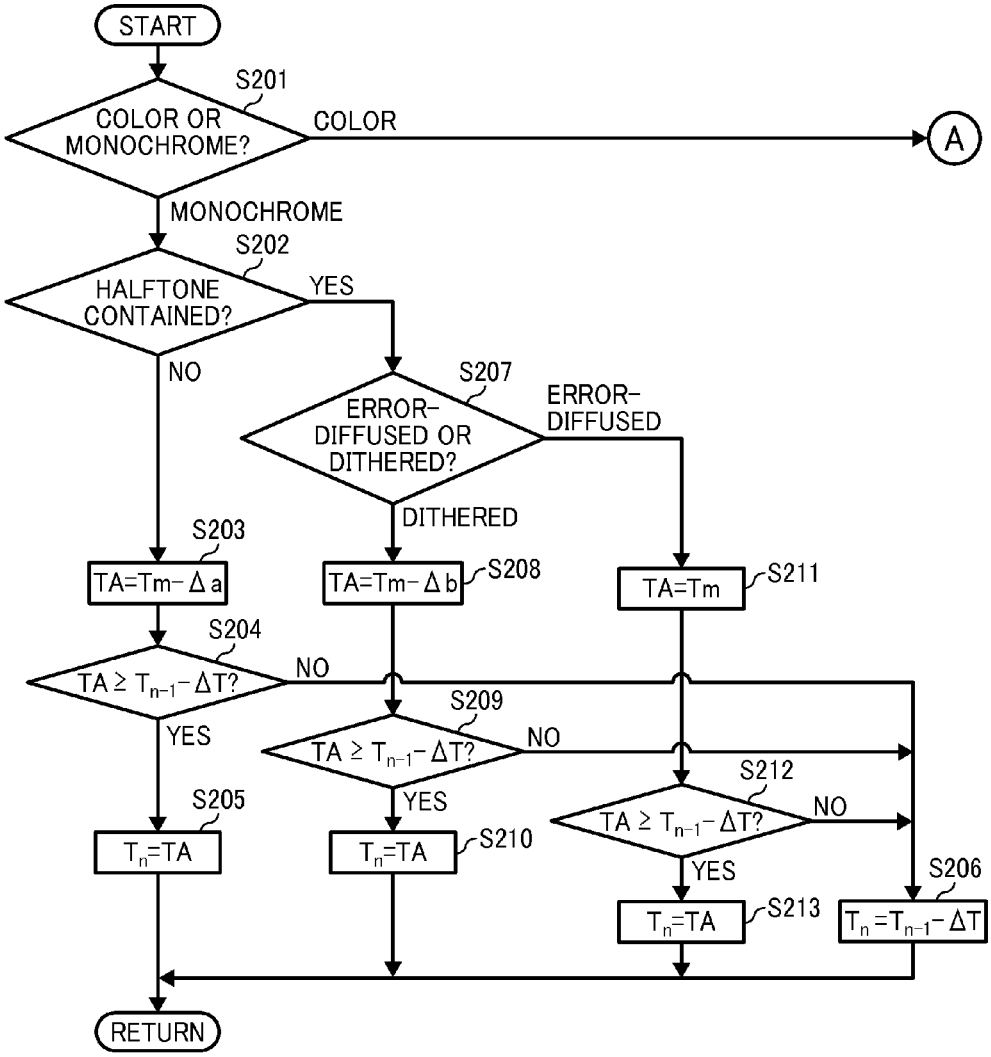
FIGS. 9A and 9B are flowcharts illustrating temperature control according to another embodiment of this patent specification.
Figure 9B:
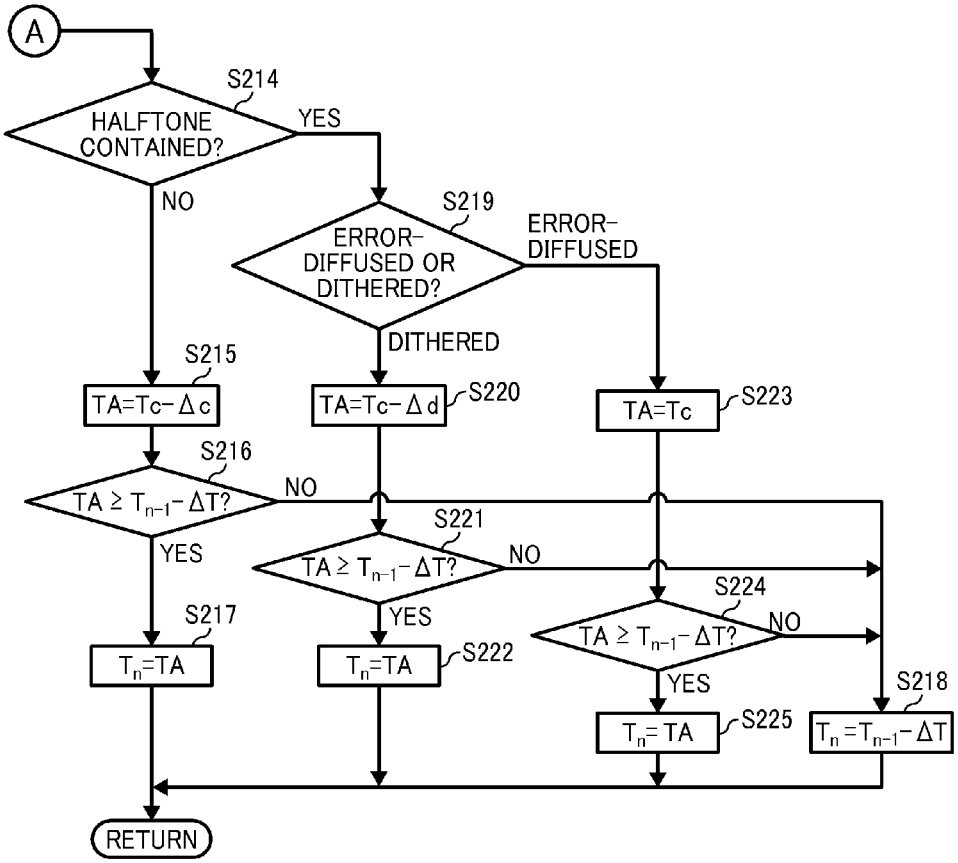

FIGS. 9A and 9B are flowcharts illustrating temperature control determining the setpoint temperature T for the current, n-th print page during sequential processing of multiple print pages according to another embodiment of this patent specification.

As shown in FIGS. 9A and 9B, the controller 200*b* initially determines whether the current, n-th print page is color or monochrome (step S201).

Where the current print page is monochrome ("MONOCHROME" in step S201), the controller 200*b* then determines whether the current print page contains a halftone or not (step S202).

Where the current print page does not contain a halftone ("NO" in step S202), the controller 102*b* subtracts the relatively large correction value Δa from the base temperature Tm for monochrome printing to obtain the primary temperature TA (step S203).

Then, the controller 200*b* compares the primary temperature TA against a difference $T_{n-1}-\Delta T$ between the setpoint temperature $T_{n-1}$ used to print the previous, (n−1)th print page and the threshold temperature difference ΔT to determine whether the primary temperature TA equals or exceeds the differential temperature $T_{n-1}-\Delta T$ (step S204).

Where the primary temperature TA equals or exceeds the differential temperature $T_{n-1}-\Delta T$ ("YES" in step S204), the setpoint temperature $T_n$ for the current print page is fixed to the primary temperature TA, that is, Tm−Δa (step S205), followed by heating the fuser belt 121 to the setpoint temperature $T_n$ thus determined.

Where the primary temperature TA is below the differential temperature $T_{n-1}-\Delta T$ ("NO" in step S204), the setpoint temperature $T_n$ for the current print page is fixed to the differential temperature $T_{n-1}-\Delta T$ (step S206), followed by heating the fuser belt 121 to the setpoint temperature $T_n$ thus determined.

Where the current print page contains a halftone ("YES" in step S202), the controller 102*b* then determines whether the current print page is halftoned through dithering or through error diffusion (step S207).

Where the current print page is halftoned through dithering ("DITHERED" in step S207), the controller 102*b* subtracts the relatively small correction value Δb from the base temperature Tm for monochrome printing to obtain the primary temperature TA (step S208).

Then, the controller 200*b* compares the primary temperature TA against a difference $T_{n-1}-\Delta T$ between the setpoint temperature $T_{n-1}$ used to print the previous, (n−1)th print page and the threshold temperature difference ΔT to determine whether the primary temperature TA equals or exceeds the differential temperature $T_{n-1}-\Delta T$ (step S209).

Where the primary temperature TA equals or exceeds the differential temperature $T_{n-1}-\Delta T$ ("YES" in step S209), the setpoint temperature $T_n$ for the current print page is fixed to the primary temperature TA, that is, Tm−Δb (step S210), followed by heating the fuser belt 121 to the setpoint temperature $T_n$ thus determined.

Where the primary temperature TA is below the differential temperature $T_{n-1}-\Delta T$ ("NO" in step S209), the setpoint temperature $T_n$ for the current print page is fixed to the differential temperature $T_{n-1}$−D (step S206), followed by heating the fuser belt 121 to the setpoint temperature $T_n$ thus determined.

Where the current print page is halftoned through error diffusion ("ERROR-DIFFUSED" in step S207), the controller 102*b* designates the base temperature Tm for monochrome printing as the primary temperature TA (step S211).

Then, the controller 200*b* compares the primary temperature TA against a difference $T_{n-1}-\Delta T$ between the setpoint temperature $T_{n-1}$ used to print the previous, (n−1)th print page and the threshold temperature difference ΔT to determine whether the primary temperature TA equals or exceeds the differential temperature $T_{n-1}-\Delta T$ (step S212).

Where the primary temperature TA equals or exceeds the differential temperature $T_{n-1}$−D ("YES" in step S212), the setpoint temperature $T_n$ for the current print page is fixed to the primary temperature TA, that is, Tm (step S213), followed by heating the fuser belt 121 to the setpoint temperature $T_n$ thus determined.

Where the primary temperature TA is below the differential temperature $T_{n-1}-\Delta T$ ("NO" in step S212), the setpoint temperature $T_n$ for the current print page is fixed to the differential temperature $T_{n-1}-\Delta T$ (step S206), followed by heating the fuser belt 121 to the setpoint temperature $T_n$ thus determined.

Where the current print page is color ("COLOR" in step S201), the controller 200*b* then determines whether the current print page contains a halftone or not (step S214).

Where the current print page does not contain a halftone ("NO" in step S214), the controller 102*b* subtracts the relatively large correction value Δc from the base temperature Tc for color printing to obtain the primary temperature TA (step S215).

Then, the controller 200*b* compares the primary temperature TA against a difference $T_{n-1}-\Delta T$ between the setpoint temperature $T_{n-1}$ used to print the previous, (n−1)th print page and the threshold temperature difference ΔT to determine whether the primary temperature TA equals or exceeds the differential temperature $T_{n-1}-\Delta T$ (step S216).

Where the primary temperature TA equals or exceeds the differential temperature $T_{n-1}-\Delta T$ ("YES" in step S216), the setpoint temperature $T_n$ for the current print page is fixed to the primary temperature TA, that is, Tc−Δc (step S217), followed by heating the fuser belt 121 to the setpoint temperature $T_n$ thus determined.

Where the primary temperature TA is below the differential temperature $T_{n-1}-\Delta T$ ("NO" in step S216), the setpoint temperature $T_n$ for the current print page is fixed to the differential temperature $T_{n-1}-\Delta T$ (step S218), followed by heating the fuser belt 121 to the setpoint temperature $T_n$ thus determined.

Where the current print page contains a halftone ("YES" in step S214), the controller 102*b* then determines whether the current print page is halftoned through dithering or through error diffusion (step S219).

Where the current print page is halftoned through dithering ("DITHERED" in step S219), the controller 102*b* subtracts the relatively small correction value Δd from the base temperature Tc for color printing to obtain the primary temperature TA (step S220).

Then, the controller 200*b* compares the primary temperature TA against a difference $T_{n-1}-\Delta T$ between the setpoint temperature $T_{n-1}$ used to print the previous, (n−1)th print page and the threshold temperature difference ΔT to determine whether the primary temperature TA equals or exceeds the differential temperature $T_{n-1}-\Delta T$ (step S221).

Where the primary temperature TA equals or exceeds the differential temperature $T_{n-1}-\Delta T$ ("YES" in step S221), the setpoint temperature $T_n$ for the current print page is fixed to the primary temperature TA, that is, Tc−Δd (step S222), followed by heating the fuser belt 121 to the setpoint temperature $T_n$ thus determined.

Where the primary temperature TA is below the differential temperature $T_{n-1}-\Delta T$ ("NO" in step S221), the setpoint temperature $T_n$ for the current print page is fixed to the differential temperature $T_{n-1}-\Delta T$ (step S218), followed by heating the fuser belt 121 to the setpoint temperature $T_n$ thus determined.

Where the current print page is halftoned through error diffusion ("ERROR-DIFFUSED" in step S219), the controller 102*b* designates the base temperature Tc for color printing as the primary temperature TA (step S223).

Then, the controller 200*b* compares the primary temperature TA against a difference $T_{n-1}-\Delta T$ between the setpoint temperature $T_{n-1}$ used to print the previous, (n−1)th print page and the threshold temperature difference ΔT to determine whether the primary temperature TA equals or exceeds the differential temperature $T_{n-1}-\Delta T$ (step S224).

Where the primary temperature TA equals or exceeds the differential temperature $T_{n-1}-\Delta T$ ("YES" in step S224), the setpoint temperature $T_n$ for the current print page is fixed to the primary temperature TA, that is, Tc (step S225), followed by heating the fuser belt 121 to the setpoint temperature $T_n$ thus determined.

Where the primary temperature TA is below the differential temperature $T_{n-1}-\Delta T$ ("NO" in step S224), the setpoint temperature $T_n$ for the current print page is fixed to the differential temperature $T_{n-1}-\Delta T$ (step S218), followed by heating the fuser belt 121 to the setpoint temperature $T_n$ thus determined.

Figure 10:
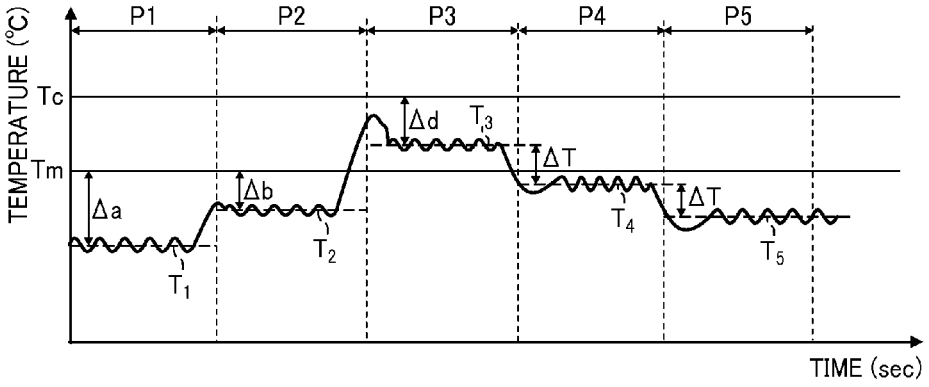
FIG. 10 is a graph plotting the temperature, in degrees Celsius (° C.), of the fuser belt against time, in seconds, during sequential processing of multiple print pages, obtained with variable setpoint temperatures determined through the temperature control of FIGS. 9A and 9B.

FIG. 10 is a graph plotting the temperature, in degrees Celsius (° C.), of the fuser belt 121 against time, in seconds, during sequential processing of multiple print pages, including a solid monochrome page P1, a dithered monochrome page P2, a dithered color page P3, a solid monochrome page P4, and a solid monochrome page P5, obtained with variable setpoint temperatures $T_1$ through $T_5$ determined through the temperature control of FIGS. 9A and 9B.

As shown in FIG. 10, the variable setpoint temperature for each print page is adjusted in a manner similar to that depicted with reference to FIG. 7, except that the setpoint temperatures $T_4$ and $T_5$ for the fourth and fifth print pages P4 and P5 are set to a temperature $T_{n-1}-\Delta T$ obtained by subtracting the threshold temperature difference $\Delta T$ from the setpoint temperature $T_{n-1}$ used to print the previous print page.

Specifically, the setpoint temperature $T_4$ for the fourth print page P4 is adjusted to the temperature $T_3-\Delta T$ obtained by subtracting the threshold temperature difference $\Delta T$ from the setpoint temperature $T_3$ used to print the third print page P3, as the primary temperature $Tm-\Delta a$ for the solid monochrome page is exceeded by the setpoint temperature $T_3$ by more than the threshold temperature difference $\Delta T$.

The setpoint temperature $T_5$ for the fifth print page P5 is adjusted to the temperature $T_4-\Delta T$ obtained by subtracting the threshold temperature difference $\Delta T$ from the setpoint temperature $T_4$ used to print the fourth print page P4, as the primary temperature $Tm-\Delta a$ for the solid monochrome page is exceeded by the setpoint temperature $T_4$ by more than the threshold temperature difference $\Delta T$.

Thus, the first and second pages P1 and P2 are processed with the respective primary temperatures obtained by subtracting the correction values $\Delta a$ and $\Delta b$, respectively, from the base temperature Tm for monochrome printing, and the third page P3 is processed with the primary temperature obtained by subtracting the correction value $\Delta d$ from the base temperature Tc for color printing. On the other hand, the fourth and fifth pages P4 and P5 are processed with the secondary temperatures obtained by subtracting the threshold temperature difference $\Delta T$ from the setpoint temperature $T_{n-1}$ used to print the previous print page, which is higher than the corrected, primary temperature.

Hence, the temperature control can adjust the setpoint temperature to the secondary temperature obtained by subtracting the threshold temperature difference $\Delta T$ from the setpoint temperature $T_{n-1}$ used to print the previous page in a condition in which a difference between the primary temperature calculated depending on properties of the current print page and the setpoint temperature used to print the previous print page exceeds the threshold temperature difference.

Further, compared to the foregoing embodiment, the temperature control adjusting the setpoint temperature $T_n$ to the differential temperature $T_{n-1}-\Delta T$, instead of the base temperature, can reduce the setpoint temperature $T_n$ to a lowest possible level that does not cause an elongated period of heater deactivation, leading to more effective energy saving.

Such arrangement effectively prevents an excessively large difference by which the setpoint temperature decreases during sequential processing of two successive print pages, which would otherwise result in an elongated period of time during which the heater remains deactivated, leading to an undesired, sudden decline in the temperature of the low-heat capacity fuser member.

In further embodiment, the controller 200*b* sets the setpoint temperature to that determined for the current print page at a switching time relative to a reference time at which the recording sheet S on which the previous print page is printed exits the fixing nip N. The switching time is variable depending on whether the setpoint temperature $T_n$ for the current print page is lower or higher than the setpoint temperature $T_{n-1}$ used to print the previous print page.

Specifically, in the present embodiment, the switching time is relatively late where the setpoint temperature $T_n$ for the current print page is lower than the setpoint temperature $T_{n-1}$ used to print the previous print page, and is relatively early where the setpoint temperature $T_n$ for the current print page is higher than the setpoint temperature $T_{n-1}$ used to print the previous print page.

More specifically, in the present embodiment, the switching time falls after the reference time where the setpoint temperature $T_n$ for the current print page is lower than the setpoint temperature $T_{n-1}$ used to print the previous print page. Further, the switching time falls before the reference time where the setpoint temperature $T_n$ for the current print page is higher than the setpoint temperature $T_{n-1}$ used to print the previous print page.

Figure 11:
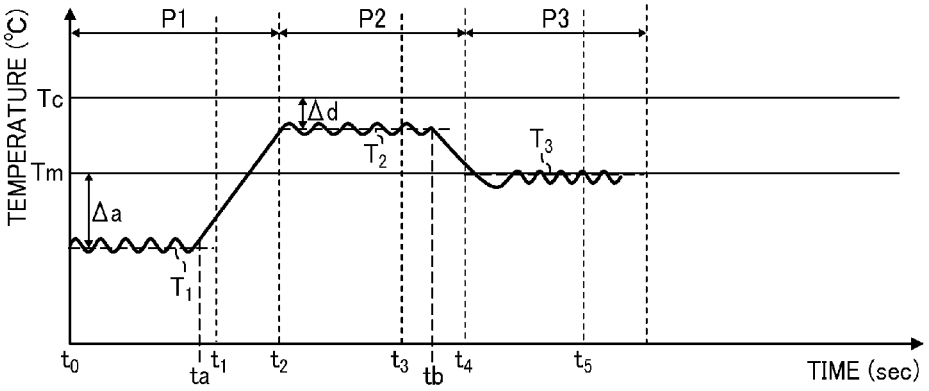
FIG. 11 is a graph plotting the temperature, in degrees Celsius (° C.), of the fuser belt against time, in seconds, during sequential processing of multiple print pages, obtained with variable setpoint temperatures determined through temperature control according to still another embodiment of this patent specification.

FIG. 11 is a graph plotting the temperature, in degrees Celsius (° C.), of the fuser belt 121 against time, in seconds, during sequential processing of multiple print pages, including a solid monochrome page P1, a dithered monochrome page P2, and a dithered color page P3, obtained with variable setpoint temperatures $T_1$ through $T_3$ determined through the temperature control according to the present embodiment.

As shown in FIG. 11, the setpoint temperature $T_2$ for the second print page P2 is higher than the setpoint temperature $T_1$ for the first print page P1, whereas the setpoint temperature $T_3$ for the third print page P3 is lower than the setpoint temperature $T_2$ for the second print page P2.

In this case, the controller 200*b* starts setting the setpoint temperature $T_2$ for the second print page P2 at a switching time to before a reference time t1 at which the recording sheet S on which the previous print page P1 is printed exits the fixing nip N, so that the relatively high setpoint temperature $T_2$ is reached at a time t2 at which the subsequent recording sheet S enters the fixing nip N.

Contrarily, the controller 200*b* starts setting the setpoint temperature $T_3$ for the third print page P3 at a switching time tb after a reference time t3 at which the recording sheet S on which the previous print page P2 is printed exits the fixing nip N, so that the relatively high setpoint temperature $T_2$ is maintained during passage of the recording sheet S.

Even though the setpoint temperature $T_3$ may not be reached at a time t4 at which the subsequent recording sheet S enters the fixing nip N due to a short time interval during which the setpoint temperature changes from $T_2$ to $T_3$, the risk of fixing failure due to insufficient heating of the fuser belt can be effectively alleviated owing to the temperature control according to the present embodiment, wherein the relatively high temperature $T_2$ is securely maintained during processing of the second print page P2, and wherein the setpoint temperature does not undergo a substantial decline upon processing of the third print page P3.

Although specific embodiments are described, the configuration of the fixing device incorporating the temperature control according to this patent specification is not limited to those specifically described herein. Several aspects of the fixing device are exemplified as follows.

In one exemplary embodiment, the fixing device 100 includes a rotatable fuser member 121, such as an endless belt, subjected to heating, a rotatable pressure member 122, such as a cylindrical roller, disposed opposite the fuser member 121. The pressure member 122 presses against the fuser member 121 to form a fixing nip N therebetween, through which a recording medium S is conveyed.

The fixing device 100 also includes a heater 123, such as a halogen heater, adjacent to the fuser member 121 to heat the fuser member 121; a temperature detector 127, such as a thermometer, directed to at least one of the fuser member 121, the pressure member 122, and the heater 123 to detect an operational temperature of the fixing device 100; and a controller 200 operatively connected to the temperature detector 127 and the heater 123 to control power supply to the heater 123 according to readings of the temperature detector 127, so as to regulate the detected operational temperature at a setpoint temperature T that is variable depending on a print page printed on the recording medium S.

During sequential processing of multiple print pages, including a current print page and a previous print page immediately preceding the current print page, the controller adjusting the setpoint temperature $T_n$ for the current print page to a primary temperature TA calculated depending on properties of the current print page where the primary temperature TA is equal to or higher than the setpoint temperature $T_{n-1}$ used to print the previous print page, and to a secondary temperature TB higher than the primary temperature TA where the primary temperature TA is lower than the setpoint temperature $T_{n-1}$ used to print the previous print page.

Such temperature control prevents an excessively large difference by which the setpoint temperature is reduced during sequential processing of two successive print pages, which would otherwise result in an elongated period of time during which the heater remains deactivated, leading to an undesired, sudden decline in the temperature of the low-heat capacity fuser member.

In other exemplary embodiment, the primary temperature TA is obtained by subtracting a correction value Δ from a base temperature selected for the current print page. The base temperature is determined depending on whether the current print page is color or monochrome. The correction value Δ is determined depending on whether the current print page contains halftone and the type of halftoning technique used. The secondary temperature TB may be equal to the base temperature for the current print page.

Such temperature control allows for setting an appropriate setpoint temperature for each specific print page depending on print properties, including print coloration, presence or absence of halftone, and type of halftoning technique used, each of which can influence susceptibility to fixing failure due to insufficient or excessive heating of the fuser member. Calculation of the setpoint temperature is relatively uncomplicated, and therefore less susceptible to error, as it involves only those print properties readily obtainable from the image information.

Further, adjusting the setpoint temperature to the secondary temperature equal to the base temperature for the current print page allows for ready implementation of the temperature control, which effectively prevents an excessive reduction in the setpoint temperature during sequential processing of two successive print pages, and a concomitant decline in the temperature of the low-heat capacity fuser member.

In other exemplary embodiment, a difference between the setpoint temperature $T_n$ adjusted for the current print page and the setpoint temperature $T_{n-1}$ used to print the previous print page does not exceed a given threshold temperature difference ΔT. The controller 200 may adjust the setpoint temperature $T_n$ for the current print page to a temperature obtained by subtracting the threshold temperature difference ΔT from the setpoint temperature $T_{n-1}$ used to print the previous print page in a condition in which a difference between the primary temperature TA calculated depending on properties of the current print page and the setpoint temperature $T_{n-1}$ used to print the previous print page exceeds the threshold temperature difference $T_{n-1}$.

Adjusting the setpoint temperature to the secondary temperature obtained by subtracting the threshold temperature difference from the setpoint temperature used to print the previous print page allows for ready implementation of the temperature control, which effectively prevents an excessive reduction in the setpoint temperature during sequential processing of two successive print pages, and a concomitant decline in the temperature of the low-heat capacity fuser member.

In other exemplary embodiment, the controller 200 starts setting the setpoint temperature $T_n$ for the current print page at a switching time relative to a reference time at which the recording medium S on which the previous print page is printed exits the fixing nip N. The switching time is variable depending on whether the setpoint temperature $T_n$ for the current print page is lower or higher than the setpoint temperature $T_{n-1}$ used to print the previous print page.

Such arrangement enables effective, timely adjustment of the setpoint temperature depending on whether the setpoint temperature increases or decreases between two successive print pages.

In other exemplary embodiment, the switching time is relatively late where the setpoint temperature $T_n$ for the current print page is lower than the setpoint temperature $T_{n-1}$ used to print the previous print page, and is relatively early where the setpoint temperature $T_n$ for the current print page is higher than the setpoint temperature $T_{n-1}$ used to print the previous print page.

Switching the setpoint temperature at a relatively early switching time where the setpoint temperature increases between two successive print pages allows for securely heating the fuser member to the desired setpoint temperature before the leading edge of the recording medium, on which the current print page is formed, reaches the fixing nip, thereby preventing fixing failure due to insufficient heating on the current print page.

Switching the setpoint temperature at a relatively late switching time where the setpoint temperature decreases between two successive print pages allows for securely heating the fuser member to the desired setpoint temperature before the trailing edge of the recording medium, on which the previous print page is formed, exits the fixing nip, thereby preventing fixing failure due to insufficient heating on the previous print page.

In other exemplary embodiment, the switching time falls after the reference time where the setpoint temperature $T_n$ for the current print page is lower than the setpoint temperature $T_{n-1}$ used to print the previous print page. Further, the switching time falls before the reference time where the setpoint temperature $T_n$ for the current print page is higher than the setpoint temperature $T_{n-1}$ used to print the previous print page.

Such arrangement more effectively secure the desired setpoint temperature is maintained during passage of the recording medium, thereby preventing fixing failure due to insufficient heating on each print page.

In other exemplary embodiment, the pressure member 122 comprises a rotatably driven cylindrical body, and the fuser member 121 comprises an endless fuser belt formed into a looped, cylindrical configuration for rotation upon rotation of the pressure member 122. The fuser member 121 has a stationary pad 124 disposed inside the loop of the fuser belt 121 against which the pressure member 122 presses via the fuser belt 121 to establish the fixing nip N. The heater 123 may be accommodated inside the loop of the fuser belt 121.

Such arrangement allows for a fast, energy-efficient fixing process with reduced energy consumption and shorter warm-up time and first-print time, owing to the use of the thin, belt-based fuser member, which exhibits a lower heat capacity and therefore requires less heat for heating to an operational temperature, compared to a roller-based fuser member. Even where the low-capacity fuser member is used, the temperature control based on the combination of primary and secondary setpoint temperatures effectively prevents fixing failure due to insufficient heating of the fuser member during successive processing of multiple print pages.

In other exemplary embodiment, the heater 123 comprises a radiant heater that directly radiates heat to the fuser member.

Such arrangement eliminates the need for providing a heat conductor for transmitting heat from the heat source to the fuser member, leading to reduced energy consumption and shorter warm-up time and first-print time in the fixing device.

In other exemplary embodiment, the temperature detector 127 is directed to the fuser member 121.

Such arrangement enables precise temperature control of the fuser member based on readings of the temperature detector, which accurately reflect changes in the operational temperature being regulated through control of the heater power supply.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device comprising:

a rotatable fuser member subjected to heating;

a rotatable pressure member opposite the rotatable fuser member, the rotatable pressure member being configured to press against the rotatable fuser member to form a fixing nip there between, a recording medium being conveyed through the fixing nip;

a heater adjacent to the rotatable fuser member and configured to heat the rotatable fuser member;

a temperature detector directed to at least one of the rotatable fuser member, the rotatable pressure member, and the heater, the temperature detector being configured to detect an operational temperature of the fixing device; and a controller connected to the temperature detector and the heater and configured to control power supply to the heater according to readings of the temperature detector, so as to regulate the detected operational temperature at a setpoint temperature that is variable depending on a print page printed on the recording medium, wherein during sequential processing of multiple print pages, including a current print page and a previous print page immediately preceding the current print page, the controller controls the power supply by adjusting the setpoint temperature for the current print page to, a primary temperature determined based on image information of the current print page when the primary temperature is equal to or higher than the setpoint temperature used to print the previous print page, and a secondary temperature higher than the primary temperature when the primary temperature is lower than the setpoint temperature used to print the previous print page.

2. The fixing device according to claim 1, wherein the controller is configured to obtain the primary temperature by subtracting a correction value from a base temperature selected for the current print page, the base temperature being determined depending on whether the current print page is color or monochrome, the correction value being determined depending on whether the current print page contains halftone and the type of halftoning technique used.

3. The fixing device according to claim 2, wherein the secondary temperature is equal to the base temperature for the current print page.

4. The fixing device according to claim 1, wherein a difference between the setpoint temperature adjusted for the current print page and the setpoint temperature used to print the previous print page does not exceed a threshold temperature difference.

5. The fixing device according to claim 4, wherein the controller adjusts the setpoint temperature for the current print page to a temperature obtained by subtracting the threshold temperature difference from the setpoint temperature used to print the previous print page in a condition in which a difference between the primary temperature determined depending on properties of the current print page and the setpoint temperature used to print the previous print page exceeds the threshold temperature difference.

6. The fixing device according to claim 1, wherein the controller is configured to start adjusting the setpoint temperature for the current print page at a switching time relative to a reference time at which the recording medium on which the previous print page is printed exits the fixing nip, the switching time being variable depending on whether the setpoint temperature for the current print page is lower or higher than the setpoint temperature used to print the previous print page.

7. The fixing device according to claim 6, wherein the switching time is relatively late where the setpoint temperature for the current print page is lower than the setpoint temperature used to print the previous print page, and is relatively early where the setpoint temperature for the current print page is higher than the setpoint temperature used to print the previous print page.

8. The fixing device according to claim 6, wherein the switching time falls after the reference time where the setpoint temperature for the current print page is lower than the setpoint temperature used to print the previous print page.

9. The fixing device according to claim 6, wherein the switching time falls before the reference time where the setpoint temperature for the current print page is higher than the setpoint temperature used to print the previous print page.

10. The fixing device according to claim 1, wherein the rotatable pressure member comprises a rotatably driven cylindrical body, and the rotatable fuser member comprises an endless fuser belt formed into a looped, cylindrical configuration for rotation upon rotation of the rotatable pressure member, the rotatable fuser member having a stationary pad disposed inside the loop of the fuser belt against which the rotatable pressure member presses via the fuser belt to establish the fixing nip.

11. The fixing device according to claim 10, wherein the heater is inside the loop of the fuser belt.

12. The fixing device according to claim 1, wherein the heater comprises a radiant heater configured to directly radiate heat to the rotatable fuser member.

13. The fixing device according to claim 1, wherein the temperature detector is directed to the rotatable fuser member.

14. An image forming apparatus incorporating the fixing device according to claim 1.

15. A method for determining a setpoint temperature at which an operational temperature of a fixing device is regulated during sequential processing of multiple print pages, including a current print page and a previous print page immediately preceding the current page, the method comprising:

controlling power supply to a heater of the fixing device according to readings of a temperature detector of the fixing device, so as to regulate the operational temperature at the setpoint temperature, the setpoint temperature being variable depending on a print page printed on a recording medium, the controlling including, adjusting the setpoint temperature for the current print page to a primary temperature determined based on image information of the current print page, when the primary temperate is equal to or higher than the setpoint temperature; and adjusting the setpoint temperature for the current print page to a secondary temperature higher than the primary temperature when the primary temperature is lower than the setpoint temperature used to print the previous print page.

16. A fixing device comprising:

a rotatable fuser member subjected to heating;

a rotatable pressure member opposite the rotatable fuser member, the rotatable pressure member configured to press against the rotatable fuser member to form a fixing nip there between, a recording medium being conveyed through the fixing nip;

a heater adjacent to the rotatable fuser member and configured to heat the rotatable fuser member;

a temperature detector directed to at least one of the rotatable fuser member, the rotatable pressure member, and the heater, the temperature detector being configured to detect an operational temperature of the fixing device; and a controller connected to the temperature detector and the heater and configured to control power supply to the heater according to readings of the temperature detector, so as to regulate the detected operational temperature at a setpoint temperature that is variable depending on a print page printed on the recording medium, wherein during sequential processing of multiple print pages, including a current print page and a previous print page immediately preceding the current print page, the controller controls the power supply by adjusting the setpoint temperature for the current print page to, a primary temperature determined based on image information of the current print page when the primary temperature is equal to or higher than the setpoint temperature used to print the previous print page, a secondary temperature higher than the primary temperature when the primary temperature is lower than the setpoint temperature used to print the previous print page, and the controller is configured to start adjusting the setpoint temperature for the current print page at a switching time relative to a reference time at which the recording medium on which the previous print page is printed exits the fixing nip, the switching time being variable depending on whether the setpoint temperature for the current print page is lower or higher than the setpoint temperature used to print the previous print page.

17. A fixing device comprising:

a temperature detector configured to detect an operational temperature of the fixing device; and a controller connected to the temperature detector and a heater of the fixing device, wherein during sequential processing of multiple print pages, including a current print page and a previous print page immediately preceding the current print page, the controller is configured to regulate the detected operational temperature by adjusting the reference temperature to, a primary temperature determined based on image information of the current print page when the primary temperature is equal to or higher than a setpoint temperature used to print the previous print page, and a secondary temperature higher than the primary temperature when the primary temperature is lower than the setpoint temperature used to print the previous print page.

18. The fixing device of claim 17, further comprising:

a rotatable fuser member;

a rotatable pressure member opposite the rotatable fuser member, the rotatable pressure member being configured to press against the rotatable fuser member to form a fixing nip, a recording medium being conveyed through the fixing nip, wherein the heater is adjacent to the rotatable fuser member and is configured to heat the rotatable fuser member.

19. The fixing device of claim 17, wherein each of the multiple print pages has an associated setpoint temperature that varies depending on the corresponding one of the multiple print pages printed on the recording medium.

* * * * *